US007160075B1

(12) United States Patent
Blackmore

(10) Patent No.: US 7,160,075 B1
(45) Date of Patent: Jan. 9, 2007

(54) STRUCTURE FOR EFFECTIVELY INCREASING USABLE GARAGE SPACE

(76) Inventor: Larry Lane Blackmore, 240 S. West Diagonal, LaVerkin, UT (US) 84745

( * ) Notice: Subject to any disclaimer, the term of this patent is extended or adjusted under 35 U.S.C. 154(b) by 246 days.

(21) Appl. No.: 10/272,218

(22) Filed: Oct. 15, 2002

(51) Int. Cl.
*E04H 6/26* (2006.01)

(52) U.S. Cl. ..... 414/229; 410/29.1

(58) Field of Classification Search ..... 414/229; 410/26–29.1
See application file for complete search history.

(56) References Cited

U.S. PATENT DOCUMENTS 2,717,088 A * 9/1955 Morley ..... 414/229
3,081,715 A * 3/1963 Moorhead et al. ..... 410/27
3,277,978 A 10/1966 Stone, Jr.
3,520,423 A * 7/1970 Gerhardt ..... 414/229
3,599,382 A 8/1971 Stone
3,628,209 A 12/1971 Parent et al.
3,941,257 A 3/1976 Matsuura
4,674,938 A 6/1987 Van Stokes et al.
4,892,452 A * 1/1990 Moynihan ..... 414/229
5,035,562 A 7/1991 Rosen
5,110,250 A 5/1992 Kuo
5,173,166 A * 12/1992 Tomantschger et al. .... 204/412
5,336,031 A 8/1994 Golan
5,354,163 A 10/1994 Mori et al.
5,525,026 A * 6/1996 DeMonte et al. ..... 414/542
5,593,266 A 1/1997 Wurzinger
5,702,222 A 12/1997 Rosen

* cited by examiner

*Primary Examiner*—Thomas J Brahan
(74) *Attorney, Agent, or Firm*—Workman Nydegger

(57) ABSTRACT

A commercial or residential garaging system having at least a first movable element and a second movable element configured to form a ramp permitting a vehicle to be moved between a first and a second elevation. A drive apparatus configured to simultaneously lower the first movable member while raising the second movable member. A frame assembly is provided to provide the strength and stability required for proper functioning of the movable members and the drive apparatus. One or more bearing assemblies having a plurality of bearing members are utilized in connection with the frame assembly and/or drive apparatus and are adapted to simultaneously lift a second and third movable member. A method for allowing vehicles to be parked so as to efficiently and quickly park vehicles utilizing a garaging system. A tire blocking apparatus is provided to prevent vehicles from advancing inadvertently.

13 Claims, 14 Drawing Sheets

STRUCTURE FOR EFFECTIVELY INCREASING USABLE GARAGE SPACE

BACKGROUND OF THE INVENTION

1. The Field of the Invention

The present invention relates to the field of garaging systems. More particularly, the present invention relates to garaging systems that make efficient use of available space to park vehicles.

2. The Relevant Technology

Covered parking has been utilized for centuries to protect various means of transportation from the elements. In ancient times barns and stables were utilized to cover coaches, chariots, wagons, and the animals utilized to pull them. With the advent of the automobile, the desire to provide a covered area continued. Garage structures were utilized to keep automobiles clean and isolated from the weather. Originally, garages were located away from dwellings. However, today garages are attached to housing structures to allow people to both park their vehicles and move items from the vehicles to the dwelling while being protected from adverse weather conditions. Garages today function to house all sorts of vehicles including cars, boats, all terrain vehicles, and recreational vehicles.

While the specific dimensions of garage structures vary according to the geographic region in which they are utilized, or the use to which they are applied, a typical two car garage covers 484 square feet while a 3 car garage covers 800 square feet. The above mentioned garages, while requiring a significant portion of the square footage of a typical building lot, still can only house two or three vehicles. Where the lot on which a garage is being built is large and inexpensive, traditional garaging systems often present little impediment to successful completion of a building project. However, where space is limited, building codes present challenges to accommodating a house and parking structure particularly where the parking structure is adapted to accommodate multiple vehicles. Additionally, where land is expensive, adding a three car or larger garage to a home can require much planning and expense.

Commercial garaging systems are adapted to maximize the number of vehicles that can be parked in a parking area. This is due to the fact that commercial garaging systems are typically located in commercial and urban areas where land is particularly valuable. Multi-level parking structures have been developed to maximize the use of the land. Multi-level parking structures utilize straight or circular ramps to move vehicles from one level to another. However, multi-level garages require massive structures and are expensive to build. Additionally, the ramps of multi-level parking structures prevent much of the square footage from being used to park vehicles.

One approach that has been utilized to maximize the square footage in residential and commercial parking structures is the use of lifts. A typical lift apparatus allows a vehicle to be lifted to a height sufficient to park another vehicle underneath. In using lifts to add additional parking space, an independent lift is required for each additional parking spot. Not only can the addition of lifts become expensive, but retrieving a vehicle parked on the lift can become inefficient as the vehicle parked beneath the lift must be moved before the vehicle on the lift can be accessed. Thus, half of all the vehicles parked using a lift apparatus cannot be accessed without first moving another vehicle.

BRIEF SUMMARY OF THE INVENTION

The present invention is directed to a garaging system adapted to maximize the number of vehicles that can be placed beneath a typical parking structure. A first movable element positioned on a first elevation and a second movable element positioned on a second elevation are configured to form a transition ramp permitting a vehicle to be moved between the first and second elevation. According to one aspect of the present invention, the first and second movable members are also configured to provide a parking space upon which a vehicle can be positioned. According to another aspect of the present invention, a third movable member is positioned on the first elevation adjacent the first movable element and above the second movable element. The third movable member is configured to raise the vehicle resting thereupon to allow a vehicle to be moved from between the first and second elevation without obstruction and without requiring removal of the vehicle resting on the third movable member. According to one aspect of the invention, three movable members allow three vehicles to be parked in and under a single car garage structure. According to another aspect of the invention, three movable members allow six cars to be parked in and under a two car garage structure.

According to one aspect of the invention, a drive apparatus is configured to provide the lifting force required to move the movable members. According to one aspect of the present invention, the drive apparatus is configured to simultaneously lower a movable first end of first movable member while lowering a movable second end of second movable member such that first movable member and second movable member form a transition ramp. According, to another aspect of the invention, the drive apparatus is configured to simultaneously move a first movable member, a second movable member, and a third movable member while maintaining the displacement between the first movable member and the second movable member.

According to another aspect of the invention, a frame assembly is provided to provide the strength and stability required for proper functioning of the movable members and the drive apparatus. In one embodiment, frame assembly provides part, or all, of the garage structure.

According to another aspect of the invention, one or more bearing assemblies are utilized in connection with a frame assembly and/or a spacer adapted to simultaneously lift a second and third movable member. In one embodiment, the bearing assembly comprises a bearing body having a plurality of bearing members adapted to contact the inner surfaces of the spacer or a frame member of the frame assembly. In one embodiment, a plurality of bearing assemblies are rigidly coupled to the frame assembly allowing the spacer member to be raised and lowered relative to frame assembly.

According to another aspect of the invention, four or more movable members are utilized in a commercial garaging system. In one embodiment, the plurality of movable members allow vehicles to be moved between three or more elevations. In another embodiment, a plurality of movable members are positioned side by side to provide a plurality of parking spots for each elevation. In yet another embodiment, a plurality of movable members are positioned front to back, or so as to mirror one another, so as to provide a plurality of parking spots for each elevation.

According to another aspect of the invention, a method is provided for allowing vehicles to be parked so as to efficiently and quickly park vehicles.

According to another aspect of the invention a tire blocking apparatus is provided to prevent vehicles from advancing along a movable member inadvertently. In one embodiment, a tire blocking apparatus is provided to prevent a vehicle from advancing in the direction of the movable end of a movable member having an decline plane. In another embodiment, a tire blocking apparatus is provided to prevent a vehicle from advancing in the direction of the fixed end of a movable member having an incline plane.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The present invention is directed to a garaging system adapted to maximize the use of the square footage of a parking structure. A first movable element positioned on a first elevation and a second movable element positioned on a second elevation are configured to form a transition ramp permitting a vehicle to be moved between the first and second elevation. According to one aspect of the present invention, the first and second movable members are also configured to provide a parking space upon which a vehicle can be positioned. According to another aspect of the present invention, a third movable member is positioned on the first elevation adjacent the first movable element and above the second movable element. The third movable member is configured to raise the vehicle thereupon to allow a vehicle to be moved between the first and second elevation without obstruction and without requiring removal of the vehicle resting on the third movable member.

Residential Garaging System

Figure 1:
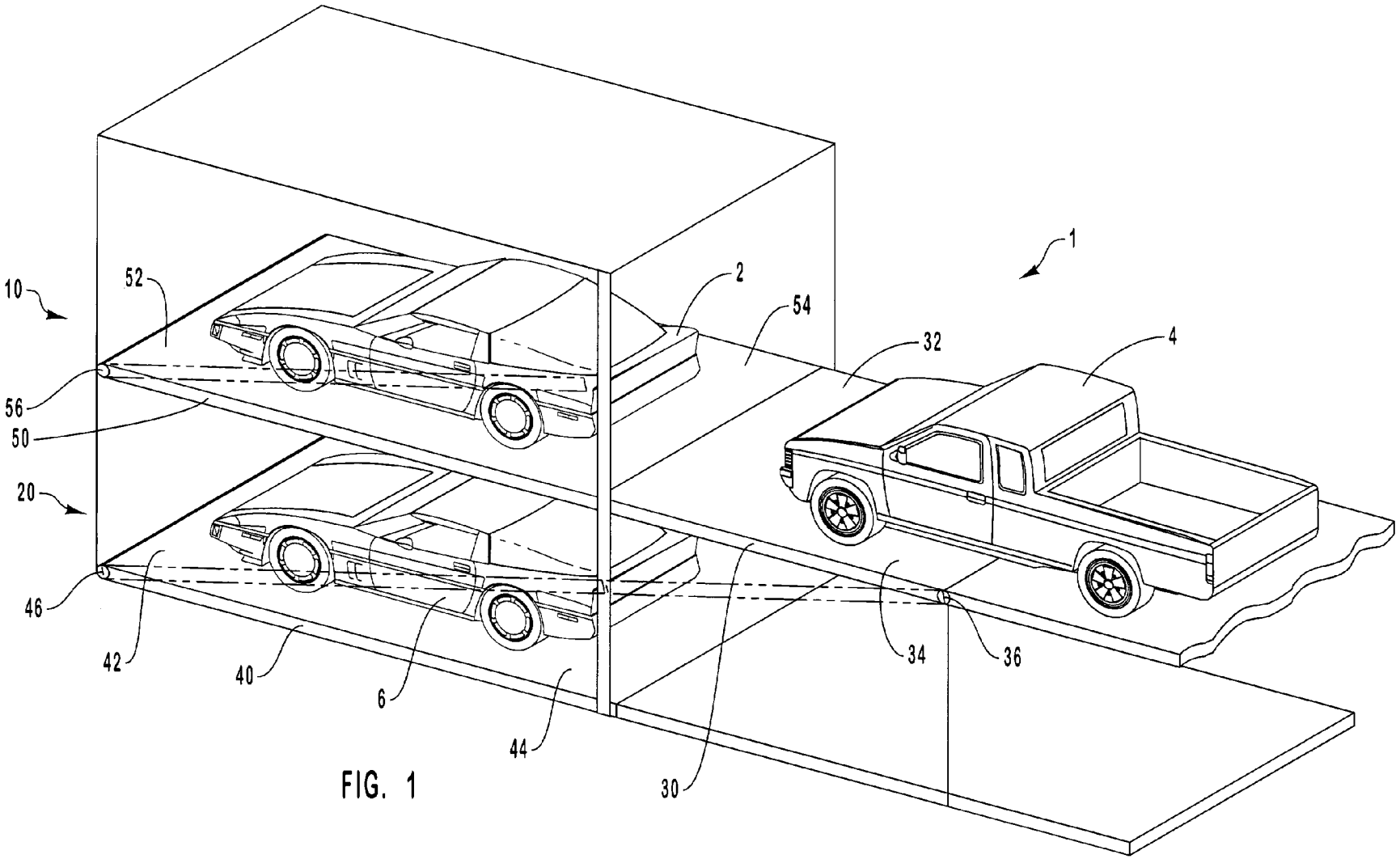
FIG. 1 is a perspective view of a garaging system for efficiently utilizing garage space and for quickly and efficiently parking vehicles according to one aspect of the present invention.

With reference now to FIG. 1, there is shown a perspective view of a garaging system 1 for efficiently utilizing garage space and for quickly and efficiently parking vehicles. In the illustrated embodiment, garaging system 1 comprises a first movable member 30, a second movable member 40, and a third movable member 50. First movable member 30 is positioned on first elevation 10 adjacent third movable member 50. First movable member 30 is configured to provide a surface for positioning a vehicle. Additionally, first movable member 30 is configured to form a ramp with second movable member 40 to permit a vehicle to be moved from first elevation 10 to second elevation 20 or from second elevation 20 to first elevation 10.

First movable member 30 comprises a first end 32, a second end 34, and a pivot member 40. First end 32 is positioned adjacent third movable member 50. First end 32 is configured to be movable so as to be lowered in the direction of second elevation 20 to meet an end of second movable member 40. Second end 34 is positioned on the end opposite first end 32. Second end 34 is configured to be stationary so as remain at first elevation 10. In the illustrated embodiment pivot member 36 comprises a hinge mechanism. Pivot member 36 is coupled to second end 34. Pivot member is configured to maintain the position of second end 34 at first elevation 10, while permitting first end 32 to be moved in the direction of second elevation 20.

Second movable member 40 is positioned on second elevation 20 beneath third movable member 50. Second movable member 40 is configured to provide a surface for positioning a vehicle. Additionally, second movable member 40 is configured to form a ramp with first movable member 30 so as to permit a vehicle to be moved between first elevation 10 to second elevation 20. Second movable member 40 comprises a first end 42, a second end 44, and a pivot member 46. First end 42 is positioned at the end of second movable member 40 opposite first movable member 30. First end 42 is configured to be fixed so as to remain at second elevation 20. Second end 44 is positioned at the end of second movable member 40 directly below first end 32 of first movable member 30. Second end 44 is configured to be movable in the direction of first elevation 10 so as to meet first end 32 of first movable member 30. Pivot member 46 is coupled to first end 42. Pivot member 46 is configured to maintain the a position of first end 46 at second elevation 20, while permitting second end 44 to be moved in the direction of first elevation 10.

Third movable member 50 is positioned adjacent first movable member 30 on first elevation 10 and above second movable member 40. Third movable member 50 is configured to provide a surface for positioning a vehicle. Additionally, third movable member 50 is configured to allow a vehicle resting thereon to be lifted. This allows a vehicle to be moved between first elevation 10 and second elevation 20, by means of a ramp formed from first movable member 30 and second movable member 40, without obstruction and without requiring that a vehicle be moved from third movable member 50. Third movable member 50 comprises a first end 52, a second end 54, and a pivot member 56. First end 52 is positioned at the end of third movable member 50 opposite first movable member 30. First end 52 is configured to be stationary so as to remain at first elevation 10. Second end 54 is positioned at the end of third movable member 50 adjacent first end 32 of first movable member 30. Second end 54 is configured to be movable so as to permit a vehicle to be moved between first elevation 10 and second elevation 20 by means of the ramp formed from first movable member 30 and second movable member 40. Pivot member 56 is coupled to first end 52. Pivot member 56 is configured to maintain the position of first end 52 at first elevation 10, while permitting second end 54 to be lifted.

In the illustrated embodiment, first vehicle 2 is positioned on third movable member 50 on first elevation 10. Second vehicle 4 is positioned on first elevation 10 with its front portion resting on first movable member 30. Third vehicle 6 is positioned on second movable member 40 on second elevation 20. In the illustrated embodiment, first movable member 30, second movable member 40, and third movable member 50 are positioned so as to provide a surface for parking a vehicle. It can be seen that, in the illustrated embodiment, a fourth vehicle can be positioned beneath first movable member 30.

Garaging system 1 is not limited to the embodiment illustrated in FIG. 1. A variety of types and configurations of garaging systems can be utilized without departing from the scope or spirit of the present invention. In one embodiment of the present invention, the garaging system only comprises a first and second movable member. In an alternative embodiment, more than three movable members are utilized so as to permit a vehicle to be moved between three or more elevations. In another alternative embodiment, a plurality of movable members are positioned side by side, so as to allow a plurality of vehicles to be simultaneously moved between a plurality of elevations (See e.g. FIGS. 11–13.)

Figure 2:
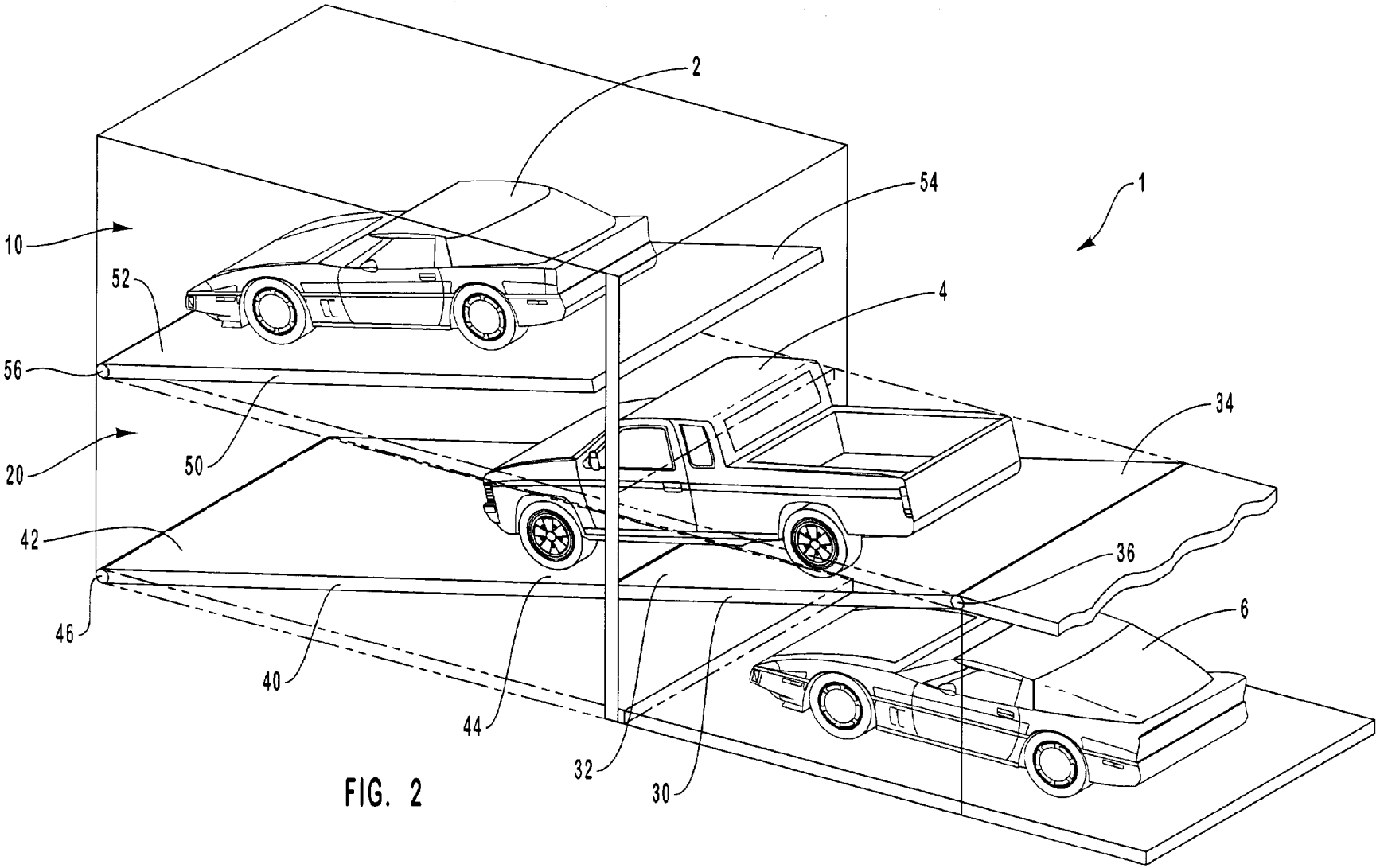
FIG. 2 is a perspective view of a garaging system in which a first movable member and a second movable member are configured to form a transition ramp according to one aspect of the present invention.

With reference now to FIG. 2, there is shown a perspective view of garaging system 1 in which the first movable member 30 and second movable member 40 are configured to form a transition ramp to permit a vehicle to be moved between first elevation 10 and second elevation 20. As shown in FIG. 2, second end 44 of second movable member 40 has been raised in the direction of first elevation 10. First end 32 of first movable member 30 has been lowered in the direction of first elevation 10. The position of first end 32 of first movable member 30 and second end 44 of second movable member 40 is such that first movable member 30 and second movable member form a transition ramp.

Third vehicle 6 has been moved from its position shown in FIG. 1 on second movable member 40 to a position below first movable member 30. This allows second vehicle 4 to be moved from first movable member 34 to second movable member 40. First end 52 of third movable member 50 and first vehicle 2 resting thereon have been lifted from the positions shown in FIG. 1 to permit second vehicle 4 to be moved from first movable member 30 to second movable member 40. Second vehicle 4 is shown passing from first movable member 30 to second movable member 40. Once second vehicle 4 is positioned entirely on second movable member 40, first movable member 30, second movable member 40, and third movable member 50 can be returned to the positions illustrated in FIG. 1. In conclusion, first movable member 30 and second movable member 40 can be configured to form a transition ramp that permits second vehicle 4 to be moved from the first elevation 10 to second elevation 20. First movable member 30 and second movable member 40 can also be utilized to move vehicles from the second elevation 20 to the first elevation 10.

Figure 3:
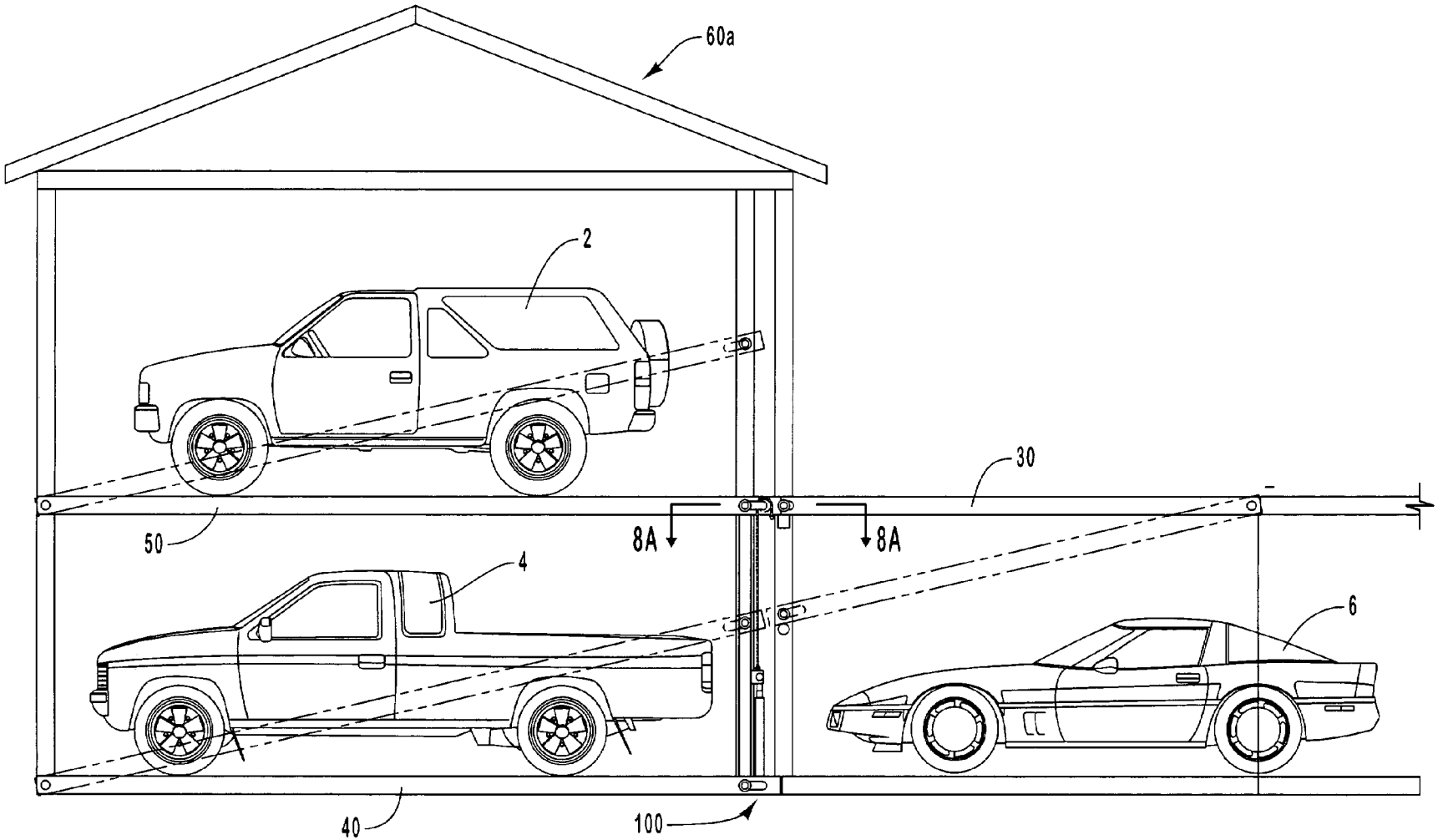
FIG. 3 is a side view of a garaging system illustrating the manner in which the garaging system can be utilized in a residential setting for allowing a user to increase the number of vehicles that can be parked in a single parking space according to one aspect of the present invention.

With reference now to FIG. 3, there is shown garaging system 1 illustrating the manner in which garaging system 1 can be utilized in a residential setting for allowing a user to increase the number of vehicles that can be parked in a single parking space. In the illustrated embodiment, garaging system 1 is utilized in connection with parking structure 60*a*. Parking structure 60*a* comprises a residential parking unit, such as a garage or carport, adapted to allow a user to park vehicles. The structure of parking structure 60*a* is consistent with a one or multiple car garage traditionally adapted to allow a user to park vehicles one deep so as to protect the one or more vehicles from the elements. In a traditional application, a single vehicle would be parked in the location where third movable member 50 is positioned. By utilizing garaging system 1 with parking structure 60*a*, three vehicles can be parked so as to be protected from the elements. First vehicle 2 is positioned on third movable member 50. Second vehicle 4 is positioned on second movable member 40. Third vehicle 6 is positioned beneath first movable member 30. A fourth vehicle can then be placed on movable member 30 if desired.

In the illustrated embodiment garaging system 1 includes a drive apparatus 100. According to one aspect of the present invention, drive apparatus 100 is configured to provide the lifting force necessary to lift the second end of the second movable member 40, the second end of the third movable member 50, and the first end of the first movable member 30. Drive apparatus 100 is adapted to simultaneously move the first end 32 of the first movable member and the second end 44 of the second movable member such that the drive apparatus 100 permits the first end 32 of the first movable member 30 to be positioned adjacent the second end 44 of the second movable member 40. By permitting the first end 32 of the first movable member 30 to be positioned adjacent to the second end 44 of the second movable member 40, the drive apparatus permits a vehicle to be moved between the first elevation and the second elevation. In the illustrated embodiment, lift apparatus 100 is also configured to lift the second end 54 of third movable member 50. In one embodiment of the present invention, a carbon monoxide monitor capable of indicating and/or exhausting when dangerous levels of carbon monoxide build up in the garage is utilized in connection with the garaging system.

A variety of types and configurations of lift apparatus can be utilized without departing from the scope and spirit of the present invention. For example, in one embodiment, a first and second lift apparatus are positioned on opposite sides of the movable members 30, 40, 50 so as to provide an equal and controlled lifting force. In an alternative embodiment a single drive apparatus is configured to provide the lifting force required to move movable members 30, 40, 50. In one embodiment, drive apparatus 100 comprises a hydraulic lift. In an alternative embodiment, drive apparatus comprises an electrical lift. In yet another embodiment, drive apparatus comprises a plurality of lifts with a separate lift configured to provide lifting force to each movable member. Lift apparatus will be discussed in greater detail with reference to FIGS. 6A, 6B, 7A, and 7B.

The configuration of garaging system 1 allows a user to access first vehicle 2, second vehicle 4, and third vehicle 6 quickly and efficiently. The use of drive apparatus 100, first movable member 30, second movable member 40, and third movable member 50 allows access to all three vehicles while requiring, that at the most, one car be moved. In other words, two of the three vehicles can be accessed without having to move other vehicles. The third vehicle can be accessed by moving a single vehicle. The drive apparatus 100 is actuated to form a ramp from first movable member 30 and second movable member 40 permitting vehicles to be moved from the second elevation 20 to the first elevation 10. The drive 3 apparatus 100 also raises third movable member 50 to allow vehicles to be moved without obstruction from third movable member 50 or a vehicle resting thereon.

In the illustrated embodiment, first vehicle 2 can be accessed by simply backing first vehicle 2 out of parking structure 60*a*. In other words, first vehicle 2 can be accessed in the manner in which vehicles are typically removed from parking structures. Second vehicle 4 can be accessed by actuating drive apparatus 100 to move movable members 30, 40, and 50 to the configuration illustrated in FIG. 2. When garaging system 1 is in the configuration illustrated in FIG. 2, second vehicle 4 can be backed out utilizing the ramp formed from first movable member 30 and second movable member 40. In other words, second vehicle 4 can be accessed by simply actuating drive apparatus 100 and then driving second vehicle up the transition ramp.

To access third vehicle 6, second vehicle 4 must be removed utilizing the process just discussed. The drive apparatus 100 is then actuated to return the garaging system 1 to the configuration illustrated in FIG. 1. Third vehicle 6 is then moved from beneath first movable member 30 to second movable member 40. Drive apparatus 100 is again actuated to move movable members 30, 40, and 50 to the configuration illustrated in FIG. 2. Third vehicle can then be backed out utilizing the transition ramp formed from first movable member 30 and second movable member 40. In other words, third vehicle can be accessed by simply actuating drive apparatus, moving second vehicle 4, returning drive apparatus to its original orientation, positioning third vehicle 6 on drive apparatus, actuating drive apparatus 100 again, and driving third vehicle 6 up the ramp.

To park the vehicles, a similar process described with reference to accessing parked vehicles 2, 4, and 6 is utilized. The drive apparatus 100 is actuated to form a transition ramp from first movable member 30 and second movable member 40 permitting vehicles to be moved from the first elevation 10 to the second elevation 20. The drive apparatus 100 also raises third movable member 50 to allow vehicles to be moved without obstruction from third movable member 50 or a vehicle resting thereon. In the illustrated embodiment, first elevation 10 is on the same elevation as entry to the garage structure 60A. In an alternative embodiment, entry to the garage structure is on second elevation 20 and the vehicles are moved from the second elevation 20 to the first elevation 10 to be parked.

Figure 4:
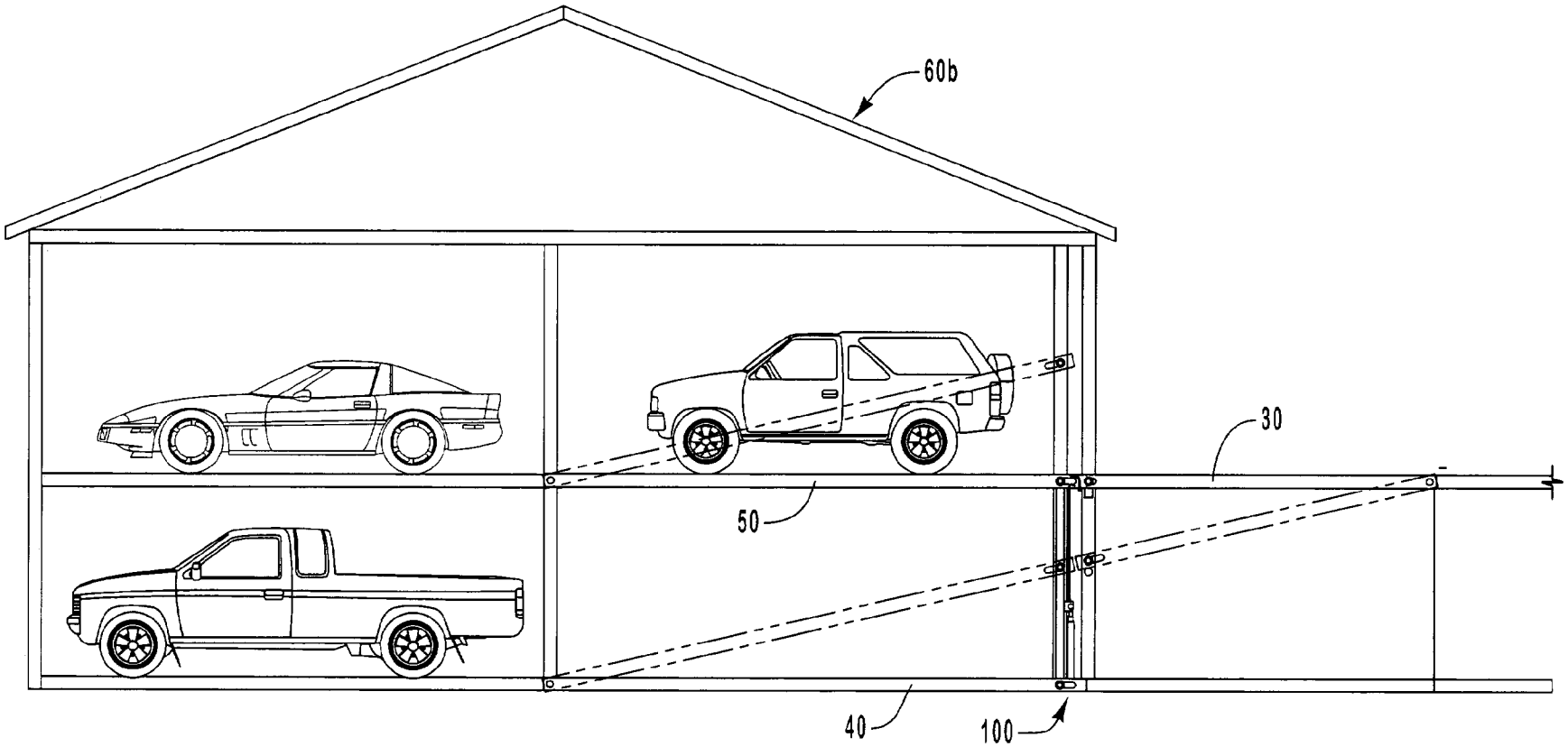
FIG. 4 is a side view of a garaging system illustrating a manner in which garaging system can be utilized in a residential setting for allowing a user to park additional vehicles in a two car parking structure according to one aspect of the present invention.

With reference now to FIG. 4, there is shown garaging system 1 illustrating another manner in which garaging system 1 can be utilized in a residential setting for allowing a user to park additional vehicles in a parking structure. In the illustrated embodiment, garaging system 1 is utilized in connection with parking structure 60*b*. Parking structure 60*b* comprises a residential parking unit, such as a garage or carport, adapted to allow a user to park vehicles. The configuration of parking structure 60*b* is consistent with a two or more car garage traditionally adapted to allow a user to park vehicles two deep so as to protect the vehicles from the elements. In a traditional application, one vehicle can be parked in the location where third movable member 50 is positioned and one vehicle can be parked in front of third movable member 50. By utilizing garaging system 1 with parking structure 60*a*, five vehicles can be parked so as to be protected by the elements. One vehicle is positioned on third movable member 50. A second vehicle is positioned in front of third movable member 50. A third vehicle can be positioned beneath the first vehicle on second movable member 40. A fourth vehicle is positioned beneath the second vehicle in front of second movable member 40. A fifth vehicle can be positioned beneath first movable member 30.

The configuration of garaging system 1 allows a user to access the vehicles quickly and efficiently. The use of drive apparatus 100, first movable member 30, second movable member 40, and third movable member 50 allows access to all five vehicles that can be parked beneath structure 60*b* and first movable member 30 while requiring, that at the most, two cars be moved. Where five cars are parked, two cars can be accessed directly. Three of the cars can be accessed by moving either the car parked on third movable member 50 or the car parked on second movable member 40. Where four cars are parked, three cars can be accessed directly. The fourth car can be accessed by moving the car parked on third movable member 50. The drive apparatus 100 is actuated to form a transition ramp utilizing first movable member 30 and second movable member 40. The transition ramp permits vehicles to be moved from the second elevation 20 to the first elevation 10. The drive apparatus 100 also raises third movable member 50 to allow vehicles to be moved without obstruction from third movable member 50 or a vehicle resting thereon. Vehicles parked on third movable member 50, second movable member 40, and beneath first movable member 30 are accessed in a manner consistent with the description of FIG. 3. The second vehicle, which is parked in front of third movable member 50, can be accessed by backing out the vehicle parked on third movable member 50 and then backing out the second vehicle. The fourth vehicle is accessed by actuating drive apparatus 100 so as to form a transition ramp from first movable member 30 and second movable member 40, backing out the third vehicle parked on second movable member 40 utilizing the transition ramp, and then backing out the fourth vehicle utilizing the transition ramp.

To park the vehicles, a similar process described with reference to accessing parked vehicles 2, 4, and 6 is utilized. The drive apparatus 100 is actuated to form a transition ramp from first movable member 30 and second movable member 40 permitting vehicles to be moved from first elevation 10 to second elevation 20. Drive apparatus 100 also raises third movable member 50 to allow vehicles to be moved without obstruction from third movable member 50 or a vehicle resting thereon.

Figure 5:
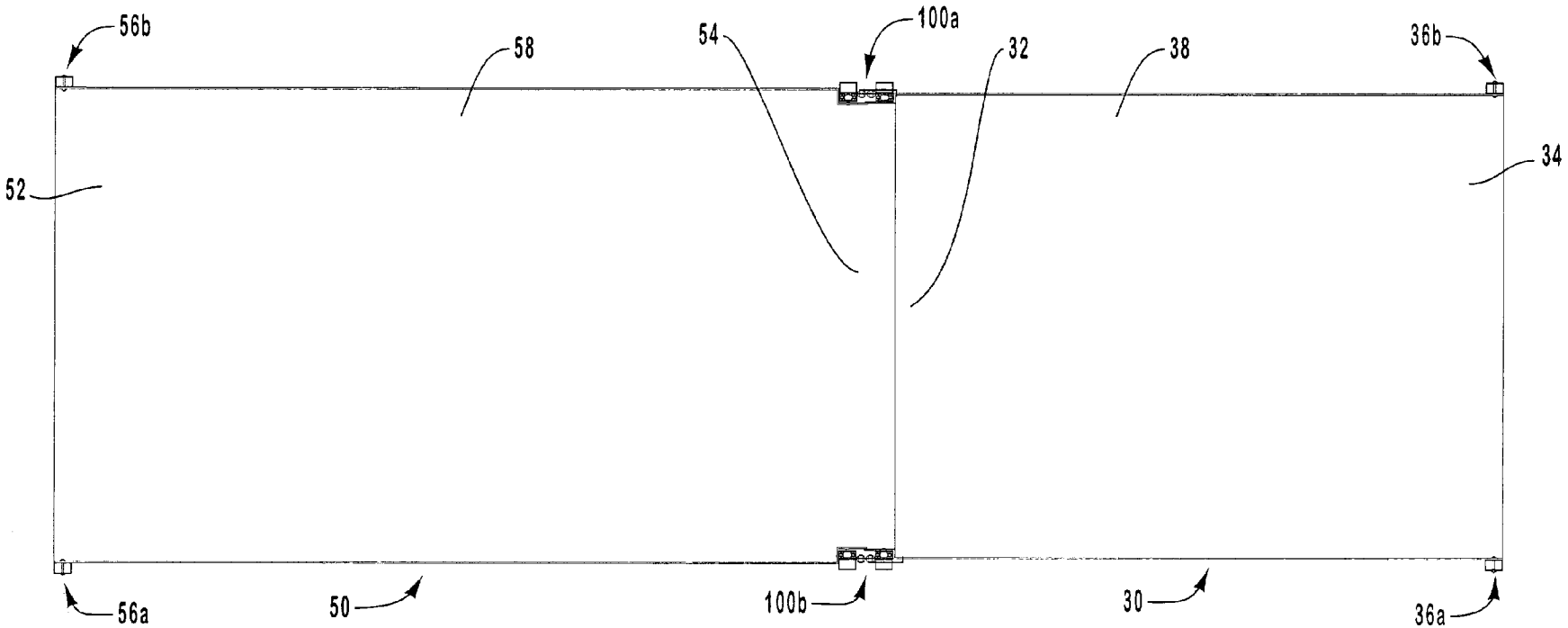
FIG. 5 is a top view of a first movable member and a third movable member according to one aspect of the present invention.

With reference now to FIG. 5, there is shown a top view of first movable member 30 and third movable member 50 according to one aspect of the present invention. There is also shown a first drive apparatus 100*a* and a second drive apparatus 100*b*. In the illustrated embodiment, first movable member 30 comprises a first end 32, a second end 34, a first pivot member 36*a*, a second pivot member 36*b*, and a deck 38.

As previously discussed, first end 32 is positioned adjacent second end 54 of third movable member 50. First end 32 is adapted to be lowered to meet second end 42 (not shown) of second movable member 40 so as to form a transition ramp utilizing first movable member 30 and second movable member 40. Second end 34 is located on the opposite end of first movable member 30. Second end 34 is configured to be fixed at a constant elevation so as to permit a vehicle to be driven onto first movable member 30 both when first end 32 is positioned adjacent second end 54 of third movable member 50 and when first end 32 is positioned adjacent second end 44 of third movable member 40.

First pivot member 36*a* and second pivot member 36*b* are coupled to second end 34. First pivot member 36*a* and second pivot member 36*b* are configured to permit first end 32 to be raised and lowered while securing second end 34. The mechanism adapted to permit first end 32 to be raised and lowered while securing second end 34 are not limited to pivot members 36*a,b*. A variety of types and configurations of pivots, hinges, or rotating mechanisms can be utilized without departing from the scope and spirit of the present invention. For example, in one embodiment, a hinge is coupled to second end 34. In another embodiment, second end 34 includes a flange which allows first movable member 30 to pivot. In an alternative embodiment, a bearing member permits first movable member 30 to pivot.

Deck 38 comprises the body of first movable member 30. Deck 38 is configured to provide structural strength to first movable member 30 as well as provide a surface on which to park and drive vehicles. A variety of types and configurations of first movable member 30 can be utilized without departing from the scope and spirit of the present invention. For example, in one embodiment, the movable member includes first and second support members for supporting the wheels of a vehicle rather than a uniform deck surface. In another embodiment, a uniform deck surface is utilized with an independent frame member.

In the illustrated embodiment, third movable member 50 comprises a first end 52, a second end 54, a first pivot member 56*a*, a second pivot member 56*b*, and a deck 58. As previously discussed, second end 54 is positioned adjacent first end 32 of first movable member 30. Second end 54 is adapted to be raised so as to allow a vehicle to be moved between a first elevation and a second elevation without obstruction from third movable member 50 and without requiring a vehicle resting thereon to be moved. First end 52 is located on the opposite end of third movable member 50. First end 52 is configured to be fixed at a constant elevation.

First pivot member 56*a* and second pivot member 56*b* are coupled to first end 52. First pivot member 56*a* and second pivot member 56*b* are configured to permit second end 54 to be raised and lowered while securing first end 52. The mechanism adapted to permit first end 52 to be raised and lowered while securing first end 52 are not limited to pivot members 56*a,b*. A variety of types and configurations of pivots, hinges, or rotating mechanisms can be utilized without departing from the scope and spirit of the present invention. For example, in one embodiment, a hinge is coupled to first end 52. In another embodiment, first end 52 includes a flange which allows third movable member 50 to pivot. In an alternative embodiment, a bearing member permits third movable member 50 to pivot.

Deck 58 comprises the body of third movable member 50. Deck 58 is configured to provide structural strength to third movable member 50 as well as provide a surface on which to park and drive vehicles. A variety of types and configurations of the third movable member can be utilized without departing from the scope and spirit of the present invention. For example, in one embodiment, the third movable member includes first and second support members for supporting the wheels of a vehicle rather than a uniform deck surface. In another embodiment, a uniform deck surface is utilized with an independent structural support member.

In the illustrated embodiment, first drive apparatus 100*a* and second drive apparatus 100*b* are coupled to first end 32 of first movable member 30 and second end 54 of third movable member 50. The manner in which first movable member 30 and third movable member 50 are coupled to first drive apparatus 100*a* and second drive apparatus 100*b* is such that drive apparatuses 100*a,b* are laterally adjacent second end 54. First drive apparatus 100*a* and second drive apparatus 100*b* are configured to provide the force required to move first end 32 of first movable member 30, second end 44 of second movable member 40, and second end 54 of third movable member 50. The manner in which the lifting force is conveyed to first movable member 30, second movable member 40, and third movable member 50 will be discussed in greater detail with reference to FIGS. 6A, 6B, 7A, 7B, and 8A.

Drive Apparatus

Figure 6A:
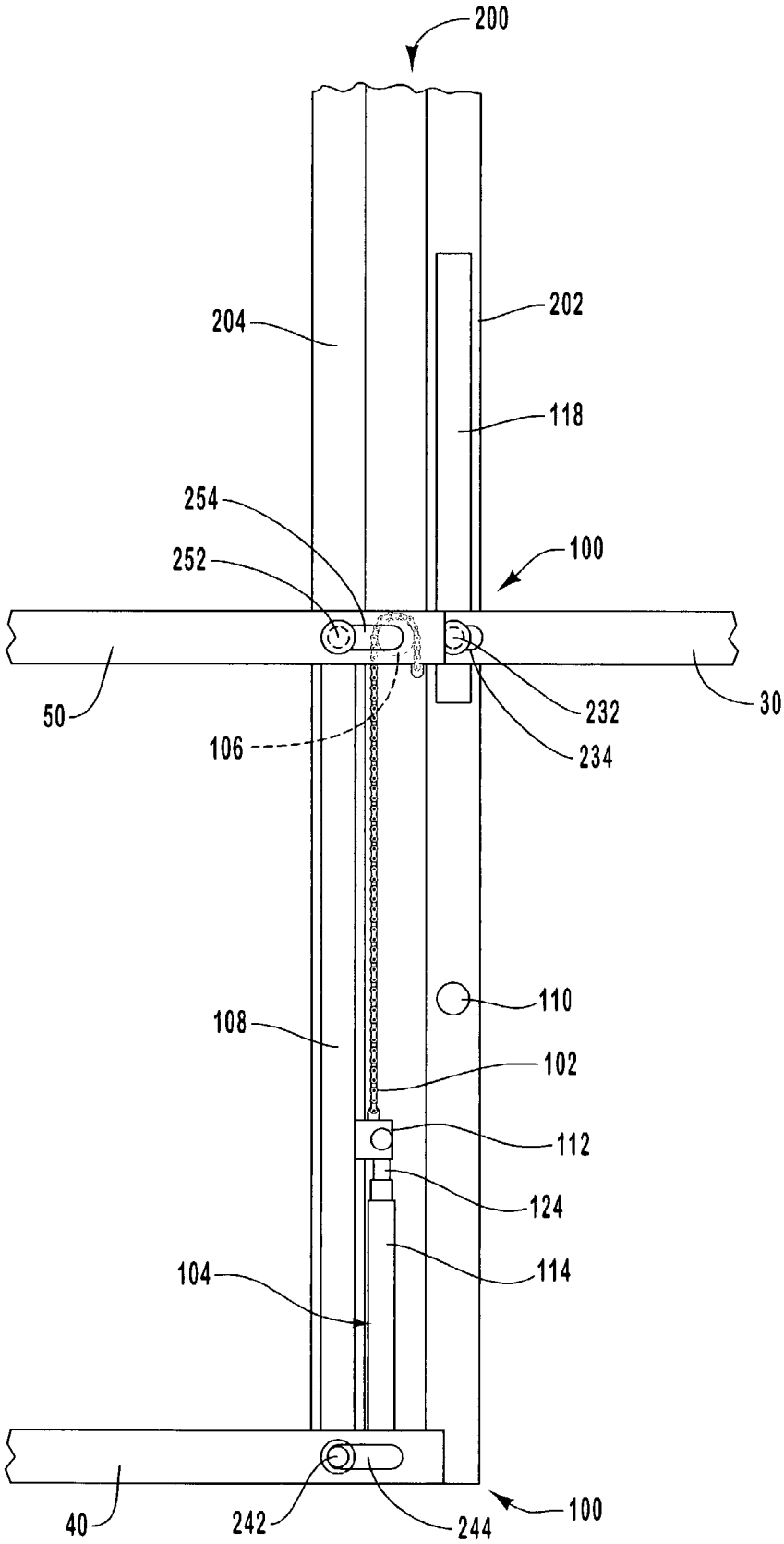
FIG. 6A is a side view illustrating a drive apparatus according to one aspect of the present invention.

With reference now to FIG. 6A, there is illustrated a portion of garaging system 1 showing drive apparatus 100 in greater detail. In the illustrated embodiment, garaging system comprises a first movable member 30, a second movable member 40, a third movable member 50, a drive apparatus 100, and a frame assembly 200. Drive apparatus 100 is configured to provide the force required to move first end 32 of first movable member 30, second end 42 of second movable member 40, and second end 52 of third movable member. In the illustrated embodiment, drive apparatus 100 comprises a displacement element 102, a driving mechanism 104, a support member 106, a spacer 108, a stop 110, and a brace member 118. Drive apparatus 100 is not limited to the configuration illustrated in FIG. 6A. For example, in one embodiment, drive apparatus is configured to only move first end 32 of first movable member 30 and second end 42 of second movable member 40. In this embodiment, no spacer 108 is utilized. In an alternative embodiment, only a displacement element, a driving mechanism, and a support member are utilized. In an another embodiment, a spacer is utilized, but is not configured to comprise a portion of drive apparatus 100.

In the illustrated embodiment, displacement element 102 comprises a chain mechanism. According to one aspect of the invention, displacement element 102 is configured to convey the force required to move the first end 32 of the first movable member 30, the second end 44 of the second movable member 40, and the second end 54 of the third movable member 50. Displacement element 102 is configured to move movable elements 30, 40, 50 both when a vehicle is positioned on one or more of movable members 30, 40, 50 and when no vehicle is positioned on the movable members 30, 40, 50. Displacement element 102 is configured to be directly or indirectly coupled to the first end 32 of the first movable member 30, the second end 44 of the second movable member 40, and the second end 54 of the third movable member 50. Displacement element 102 is indirectly coupled to the second end 44 of the second movable member 40, and the second end 54 of the third movable member 50 by being coupled to spacer 108 by means of a coupling 112.

Displacement element 102 is not limited to the mechanism illustrated in FIG. 6A. A variety of types and configurations of displacement elements can be utilized without departing from the scope and spirit of the present invention. For example, in one embodiment, the displacement mechanism is coupled only to a first movable member and a second movable member. In another embodiment, the displacement mechanism is only configured to provide the force required to move first end 32 of first movable member 30. In an alternative embodiment, the displacement mechanism comprises a cable member. In yet another alternative embodiment, displacement mechanism comprises a plurality of gear mechanisms adapted to convey the force required to move the ends of the movable members.

In the illustrated embodiment, driving mechanism 104 comprises a hydraulic lift. Driving mechanism 104 is coupled to displacement element 104. Driving mechanism 104 is adapted to provide lifting force to the displacement element. In the illustrated embodiment, driving mechanism 104 is configured to provide the force required to move the first end 32 of the first movable member 30, the second end 44 of the second movable member 40, and the second end 54 of the third movable member 50 both when a vehicle is positioned on one or more of movable members 30, 40, 50 and when no vehicle is positioned on the movable members 30, 40, 50. In the illustrated embodiment, driving mechanism 104 comprises a housing 114 and an arm 124. In the illustrated embodiment, housing 114 is configured to enclose arm 124 as well as any internal hydraulics required to extend or retract arm 124. In the illustrated embodiment, arm 124 comprises a telescoping rod. Arm 124 is coupled to spacer 108 by means of displacement element 102 by means of coupling 112.

The driving mechanism is not limited to the configuration illustrated in FIG. 6A. A variety of types and configurations of driving mechanism can be utilized without departing from the scope and spirit of the present invention. For example, in one embodiment, the driving mechanism comprises a hydraulic lift having a non-telescoping arm. In another embodiment, the driving mechanism comprises an electrical powered lift. In yet another embodiment, driving mechanism comprises a motor configured to provide rotational force to a gear assembly. In yet another embodiment, driving mechanism comprises two or more lift mechanisms where the first lift mechanism is configured to provide the force required to lower the first end 32 of the first movable member 30, lift the second end 44 of the second movable 3 member 40, and lift the second end 54 of the third movable member 50. The second lift mechanism is configured to provide the force required to lift the first end 32 of the first movable member 30, lower the second end 44 of the second movable member 40, and lower the second end 54 of the third movable member 50.

In the illustrated embodiment, support member 106 comprises a pulley. Support member 106 is adjacent first end 32 of first movable member 40 and second end 54 of third movable member 50. Support member 106 is adapted to interact with the displacement element such that movement of the displacement element simultaneously moves the first end 32 of the first movable member and the second end 44 of the second movable member 40 towards, or away from, each other. A variety of types and configurations of support members can be utilized without departing from the scope and spirit of the present invention. For example, in one embodiment, support member 106 comprises a rod. In the embodiment, the rod is adapted to interact with a displacement element comprising a cable member. In an alternative embodiment, support member comprises one or more members adapted to permit a plurality of gears to simultaneously move the first end of the first ramp towards the second end of the second ramp.

In the illustrated embodiment, spacer 108 comprises a brace member. Spacer 108 is configured to be coupled to second end 44 of second movable member 40 and second end 54 of third movable member 50 such that second movable member 40 and third movable member 50 move in parallel. The force required to move second movable member 40 and third movable member 50 is exerted on spacer directly 108. The spacer is not limited to the configuration illustrated in FIG. 6A. A variety of types and configurations of spacers can be utilized without departing from the scope and spirit of the present invention. For example in one embodiment, driving mechanism 104 exerts a lifting force directly on third movable member 50 and the spacer comprises a tensile member adapted to ensure that second movable member 40 moves in parallel with third movable member 50. In an alternative embodiment, driving mechanism 104 exerts a lifting force directly on second movable member 40 and spacer comprises an arm member adapted to ensure that third movable member 50 moves in parallel with second movable member 40.

Brace member 118 is configured to be coupled to first end 32 of first movable member 30. Brace member 118 is configured to permit first end 32 to be lowered and raised in a smooth and efficient manner. In one embodiment, the force required to move first end 32 is exerted directly on brace member 118. In an alternative embodiment, the force required to move first end 32 is exerted directly on movable member 30. Stop 110 is configured to interact with brace member 118 to prevent brace member 118 from lowering past a given point. Stop 110 can comprise any mechanism adapted to interact with brace member 118 or movable member 30 including, but not limited to, a protrusion on a frame member, a pin, a rod, or the like.

There is also shown a frame assembly 200. In the illustrated embodiment, frame assembly 200 is configured to provide support to garaging system 1. Frame assembly 200 comprises a first frame member 202 and a second frame member 204. Frame assembly is not limited to the configuration illustrated in FIG. 6A. For example, in one embodiment, frame assembly 200 is configured such that the length of second frame member 204 corresponds with the length of spacer 108. In another embodiment, frame assembly 200 is configured to comprise part or all of the structure of a parking structure. A variety of types and configurations of frame assemblies can be utilized without departing from the scope and spirit of the present invention.

In the illustrated embodiment, first frame member 202 comprises a steel support frame. First frame member 202 is positioned laterally to drive apparatus 100 and adjacent to second movable member 40 and third movable member 50. First frame member 202 is configured to provide support to various components of garaging system 1 including second movable member 40 and third movable member 50. Additionally, first frame member 202 allows spacer 108 to move second end 44 of second movable member 40 and second end 54 of third movable member 50 in a safe and efficient manner.

In the illustrated embodiment, second frame member 204 comprises a steel support frame. Second frame member 204 is positioned laterally to drive apparatus 100 and adjacent to first movable member 30 and second movable member 40. First frame member 202 is configured to provide support to various components of garaging system 1 including first movable member 30. Additionally, second frame member 202 allows a brace element 118 to move first end 32 of first movable member 30 in a safe and efficient manner.

There is also shown pins 232, 242, 252 and slots 234, 244, 254 which are utilized in connection with first movable member 30, second movable member 40, and third movable member 50. Pin 232 is rigidly coupled to brace member 118. When force is exerted on brace member 118 causing brace member 118 to move, pin 232 causes first movable member 30 to move. Because movement of first end 32 of first movable member 30 causes a change in the displacement between brace member 118 and first end 32 of first movable member 30, a slot 234 is provided in first movable member 30. The configuration of slot 234 permits pin 232 to remain in its natural orientation to brace member 118 while the displacement between brace member 118 and first end 32 is changing.

Pins 242 and 252 are rigidly coupled to spacer 108. When force is exerted on spacer 108 causing spacer 108 to move, the pins 242 and 252 causes second movable member 40 and third movable member 50 to move. Because movement of second end 44 of second movable member 40 and second end 54 of third movable member 50 causes a change in the displacement between spacer 108 and both second end 44 of second movable member 40 and second end 54 of third movable member 50, slots 244 and 254 are provided in second movable member 40 and third movable member 50. The configuration of slots 244 and 254 permits pins 242 and 252 to remain in their natural orientation to spacer 108 while the displacement between spacer 108 and second ends 44 and 54 are changing. In the illustrated embodiment, pins 232, 242, and 252 comprise ridged roller pins adapted to rotate so as to reduce the friction with slots 234, 244, and 254. A variety of types and configurations of mechanisms can be utilized to permit the end of the movable members to change in displacement from the brace member without departing from the scope and spirit of the present invention.

Figure 6B:
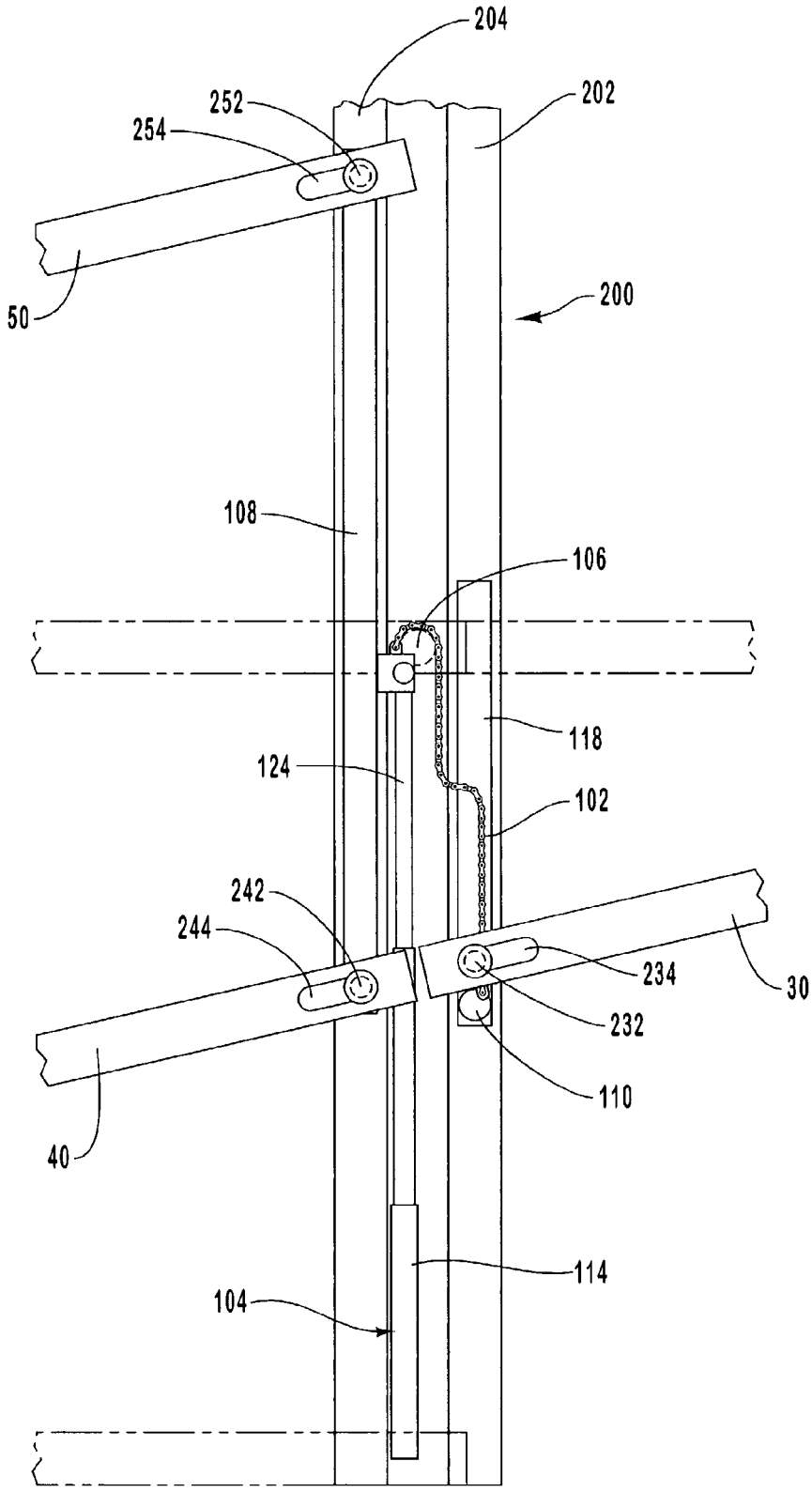
FIG. 6B is a side view illustrating the manner in which drive apparatus can be utilized to simultaneously move movable members according to one aspect of the present invention.

With reference now to FIG. 6B, there is shown the manner in which lift apparatus can be utilized to move first end 32 of first movable member 30, second end 44 of second movable member 40, and second end 54 of third movable member 50. In the illustrated embodiment it can be seen that arm 124 of driving mechanism 104 is in an extended position. Extension of arm 124 causes movement and displacement of spacer 108, brace member 118, and displacement element 102, as illustrated. Due to the direct or indirect coupling of spacer 108 and displacement element 102, the illustrated positions of spacer 108, brace member 118, and displacement element 102 results in movement of first movable member 30, second movable member 40, and third movable member 50. As a result, first movable member 30 and second movable member 40 form a ramp allowing a vehicle to be moved between the first elevation to the second elevation, as illustrated in FIG. 2. Third movable member 50 is lifted so allow a vehicle to be moved between the first and second elevation without obstruction. Thus, extension and retraction of driving mechanism 104 and the configuration of drive apparatus 100 permits the movable member 30, 40, 50 to be moved between the positions illustrated in FIG. 1 and FIG. 2.

Figure 7A:
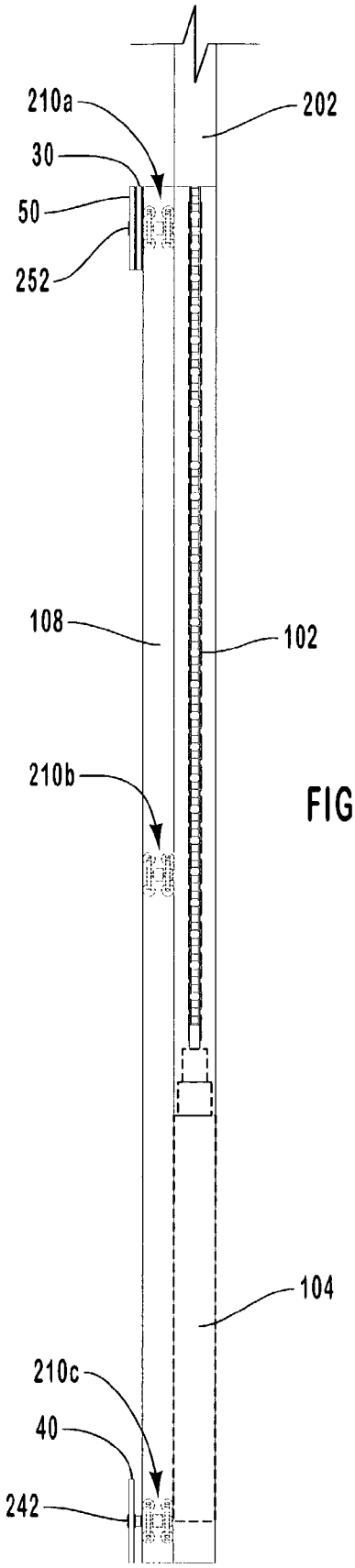
FIGS. 7A and 7B are an end view illustrating the manner in which lift apparatus and frame assembly interact to move movable members according to one aspect of the present
Figure 7B:
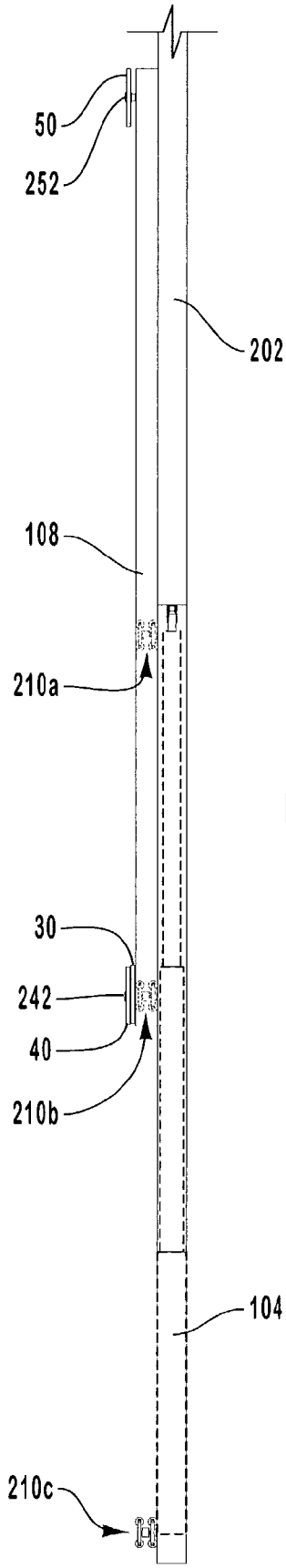

With reference now to FIGS. 7A and 7B, there is shown a cross-sectional front view of frame assembly 200 and drive apparatus 100 illustrating the manner in which frame assembly 200 interacts with drive apparatus 100 to move second end 44 of second movable member 40 and second end 54 of third movable member 50. In the illustrated embodiment, frame assembly 200 includes a first bearing assembly 210*a*, a second bearing assembly 210*b*, and a third bearing assembly 210*c*. The configuration of the bearing assemblies will be discussed in greater detail with reference to FIGS. 8A and 8B. First bearing assembly 210*a*, second bearing assembly 210*b*, and third bearing assembly 210*c* are configured to be positioned internally to spacer 108 while being rigidly affixed to first frame member 202. First bearing assembly 210*a*, second bearing assembly 210*b*, and third bearing assembly 210*c* are adapted to allow spacer 108 to be raised and lowered, relative to first frame member 202, in a smooth and efficient manner.

With reference now to FIG. 7A, driving mechanism 104 is retracted and spacer 108 is positioned such that the bottom of spacer 108 is at the first elevation. When spacer 108 is in the position illustrated in FIG. 7A, second movable member 40 and third movable member 50 have a horizontal orientation as shown in FIG. 6A. First movable member 30 is positioned adjacent third movable member 50. First bearing assembly 210*a* is positioned internal to the top portion of spacer 108. Second bearing assembly 210*b* is positioned internal to the middle portion of spacer 108. Third bearing assembly 210*c* is positioned internal to the bottom portion of spacer 108.

With reference now to FIG. 7B, driving mechanism 104 is extended and spacer 108 is positioned such that the top of spacer 108 is at the second elevation situating second movable member 40 and third movable member 50 in a diagonal configuration as shown in FIG. 6B. First movable member 30 is positioned adjacent second movable member 40. First bearing assembly 210*a* is positioned internal to the middle portion of spacer 108. Second bearing assembly 210*b* is positioned internal to the bottom portion of spacer 108. Third bearing assembly 210*c* is positioned substantially below the bottom portion of spacer 108. The orientation of bearing assemblies 210*a,b,c* relative to first frame member 202 has not changed. Rather the orientation of bearing assemblies 210*a,b,c* has changed relative to spacer 108 due to movement of spacer 108.

Figure 8A:
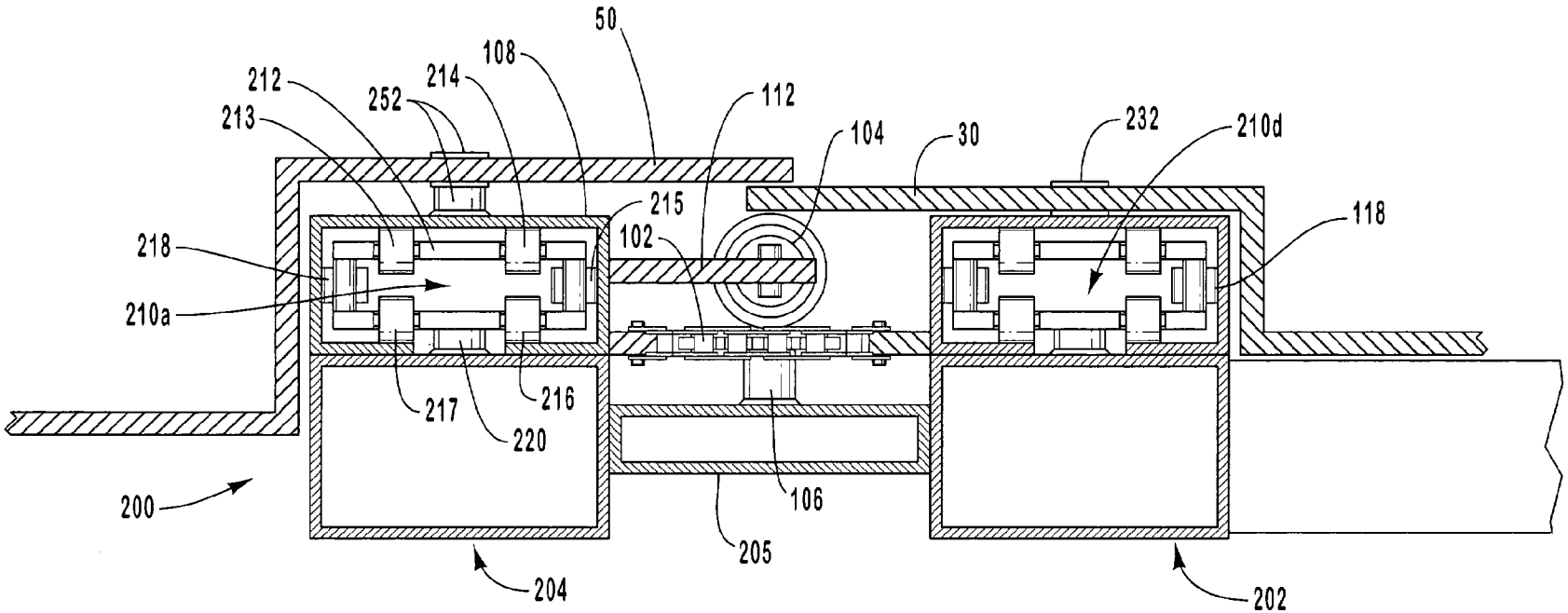
FIG. 8A is a top cross-sectional view showing frame assembly and lift apparatus illustrating a bearing assembly according to one aspect of the present invention.

With reference now to FIG. 8A, there is shown a cross-sectional top view taken along lines 8A of FIG. 3 showing frame assembly 200 and drive apparatus 100 and illustrating bearing assembly 210*a* in greater detail. There is also shown a bearing assembly 210*d*. In the illustrated embodiment, frame assembly 200 comprises a first frame member 202, a second frame member 204, and a third frame member 205. First frame member 202 and second frame member 204 are discussed in greater detail above with reference to FIG. 6A. In the illustrated embodiment, third frame member 205 comprises a hollow metal brace. Third frame member 205 is coupled to, and positioned between, first frame member 202 and second frame member 204. Third frame member 205 is coupled to, and provides support for, support member 106.

As discussed with reference to FIGS. 7A and 7B, bearing assemblies are configured to be positioned internal to spacer 108. Bearing assembly 210*d* is fixedly coupled to second frame member 204. Bearing assembly 210*d* comprises a bearing body 212, a first bearing member 213, a second bearing member 214, a third bearing member 215, a fourth bearing member 216, a fifth bearing member 217, a sixth bearing member 218, and a pin 220. Bearing body 212 is configured to provide support to the other components of bearing assembly 210*d*. In the illustrated embodiment, bearing body 212 comprises a circumferential frame structure. In an alternative embodiment, bearing body comprises a solid core member to which the additional components are coupled.

In the illustrated embodiment, bearing members 212, 213, 214, 215, 216, 217, and 218 comprise steel roller bearings. A variety of types of bearings members can be utilized, including but not limited to, static Ultra High Molecular Weight Polyethylene bearing members. Bearing members 212, 213, 214, 215, 216, 217, and 218 are adapted to contact the internal surfaces of spacer 108. Bearing members 212, 213, 214, 215, 216, 217, and 218 reduce the friction that can be experienced when spacer 108 is lifted and lowered. Pin 220 is fixedly coupled to second frame member 204. Pin 220 secures bearing assembly 210*d* relative to second frame member 204 so as to permit bearing assembly 210*d* to allow brace member 118 to be raised and lowered relative to second frame member 204.

Bearing member 210*a* operates with reference to brace member 108 and first frame member 202 in a manner analogous to bearing member 210*d*. Bearing members 210*a*, 210*d*, spacer 108, and brace member 118 are merely one example of the mechanism that can be utilized to allow movable members to be moved in a smooth and efficient manner. For example, in one embodiment, a movable bearing member is coupled to the movable end of a movable member. In the embodiment, the bearing member is positioned internal to a frame member having a slot. Actuation of the lift apparatus 100 results in movement of the movable end of the movable member and the bearing member.

Figure 8B:
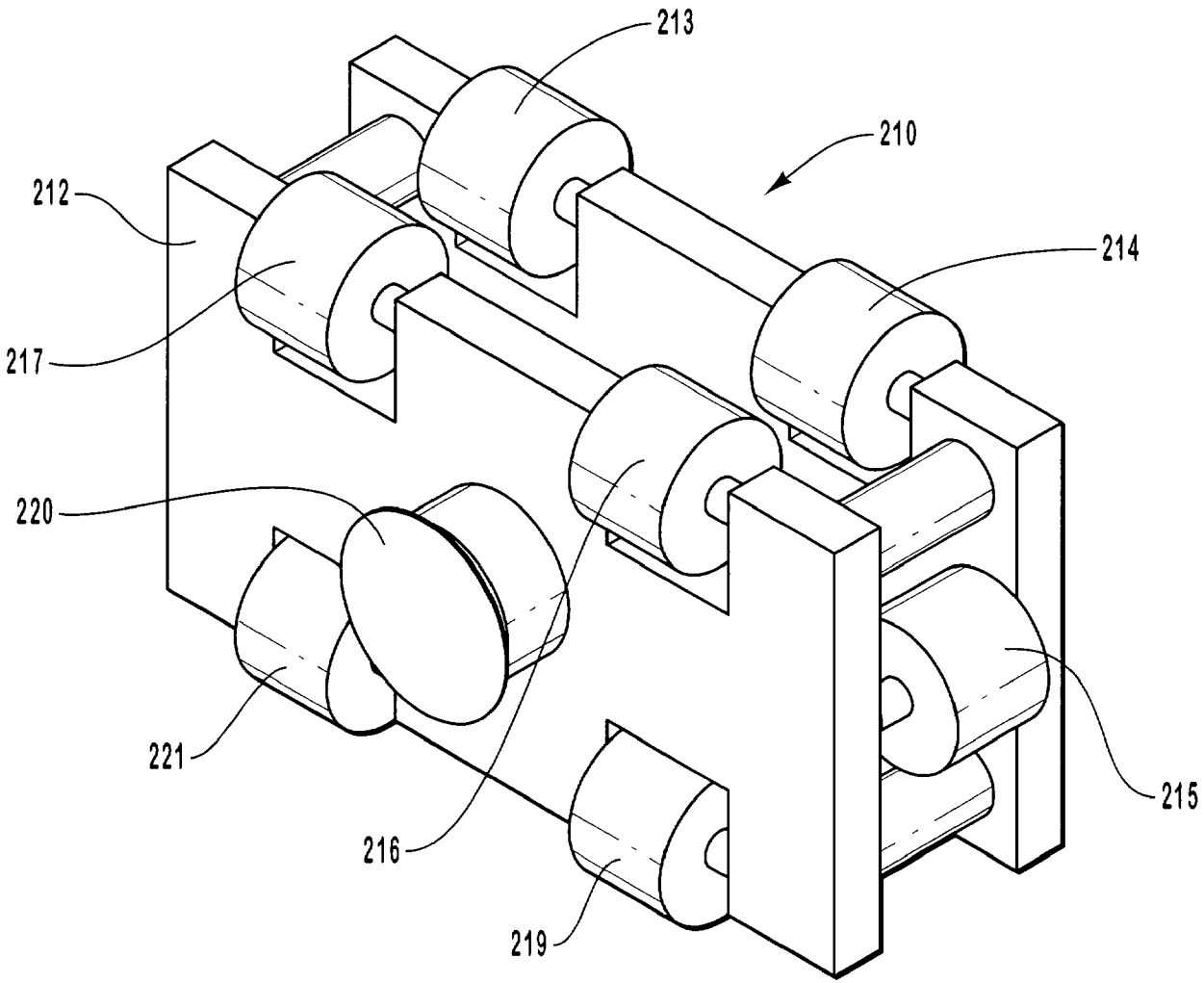
FIG. 8B is perspective view of a bearing assembly according to one aspect of the present invention.

With reference now to FIG. 8B, there is shown a perspective view of bearing assembly 210. In the embodiment, bearing body 212 comprises a first and second plate joined by pin members. There is shown bearing members 213, 214, 215, 216, 217, 219, and 221. By having bearing members positioned on the top of bearing body, i.e. 213, 214, 216, 217; the bottom of bearing body, i.e. 219 and 221; and sides of bearing body, i.e. 215; lateral movement of bearing assembly 210 and spacer 108 is prevented.

Tire Blocking Apparatus

Figure 9:
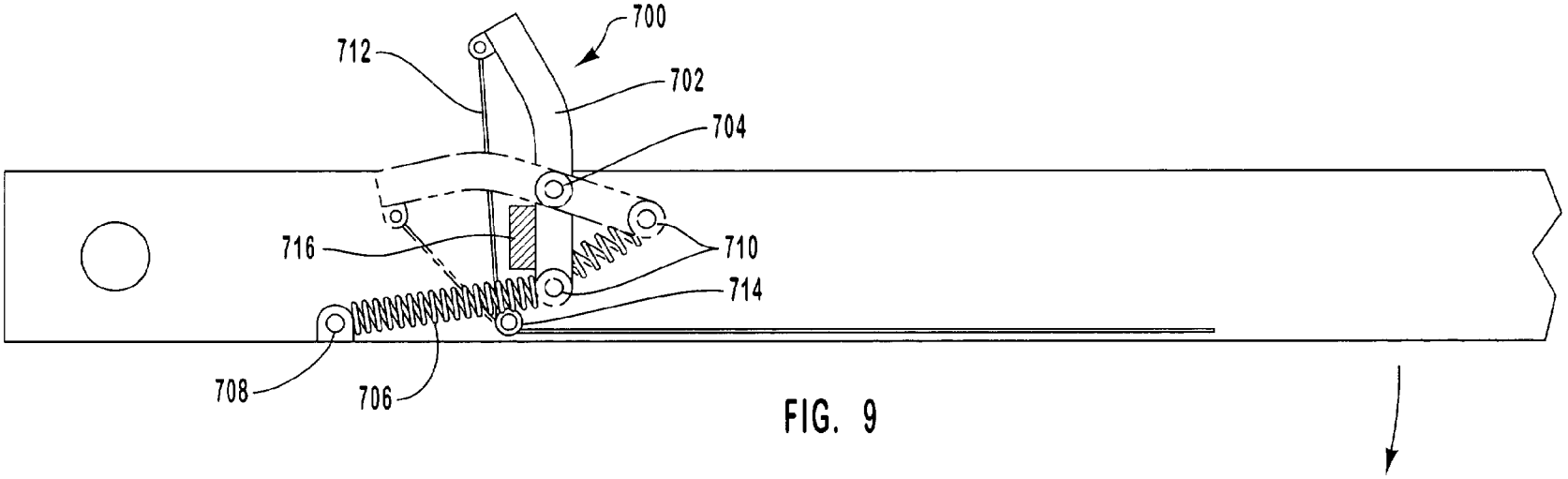
FIG. 9 illustrates a tire blocking apparatus adapted to prevent advancement of a vehicle in the direction of the movable end of a movable member configured to have an decline plane according to one aspect of the present invention.

With reference now to FIG. 9, there is shown a tire blocking apparatus 700. Tire blocking apparatus 700 is positioned on a movable member that is configured to have a movable end that can be positioned lower than the fixed end such that the movable member can be positioned on an incline plane. First movable member 30 is an example of a movable member that can be positioned on an incline plane. Tire blocking apparatus 700 is configured so as to allow a vehicle to pass over tire blocking apparatus 700 in one direction, while optionally preventing passage of the vehicle in the other direction. In the illustrated embodiment, many of the components of tire blocking apparatus 700 are configured to be positioned beneath the driving surface of the movable member. Tire blocking apparatus 700 comprises an arm 702, a pivot 704, a biasing mechanism 706, a fastener 708, a fastener 710, and a control cable 712.

Arm 702 is configured to obstruct the tire of a vehicle resting on the movable member from passing over arm 702. Tire blocking apparatus is configured so that arm 702 is normally positioned in an upright position. The angular configuration of arm 702 is adapted such that when a tire contacts arm 702 from the direction of the movable end of the movable member, the arm will rotate allowing the tire to pass over arm 702. However, when a tire contacts arm 702 from the direction of the fixed end of movable member the arm will stay in a fixed upright position and the vehicle will be prevented from advancing in the direction of the movable end of movable member. Because the movable end of the movable member is at times at the lowest position on an inclined plane, by preventing the vehicle from advancing in the direction of the movable end of movable member, the tire blocking apparatus 700 prevents the vehicle from inadvertently rolling.

In the illustrated embodiment, pivot 704 is coupled to the middle or lower portion of arm 702. Pivot 704 provides an axis about which arm 702 rotates. Biasing mechanism 706 is adapted to optionally maintain arm 702 in an upright position. In the illustrated embodiment, biasing mechanism is coupled to movable member by means of fastener 708 and arm 702 by means of fastener 710. A control cable 712 is coupled to the top of arm 702. Control cable 712 is configured to be utilized as part of a release mechanism which is adapted to allow a user or operator to rotate arm 702 into a retracted position to allow a vehicle to be moved toward the movable end of movable member. A stop 716 is positioned to prevent rotation of arm 702 when a tire contacts arm 702 from the fixed end of the movable member. As can be appreciated by those skilled in the art, a variety of types and configurations of tire blocking apparatuses can be utilized without departing from the scope or spirit of the present invention. For example, in one embodiment, a release mechanism not having a cable member is utilized to allow a vehicle to pass over tire blocking apparatus.

Figure 10:
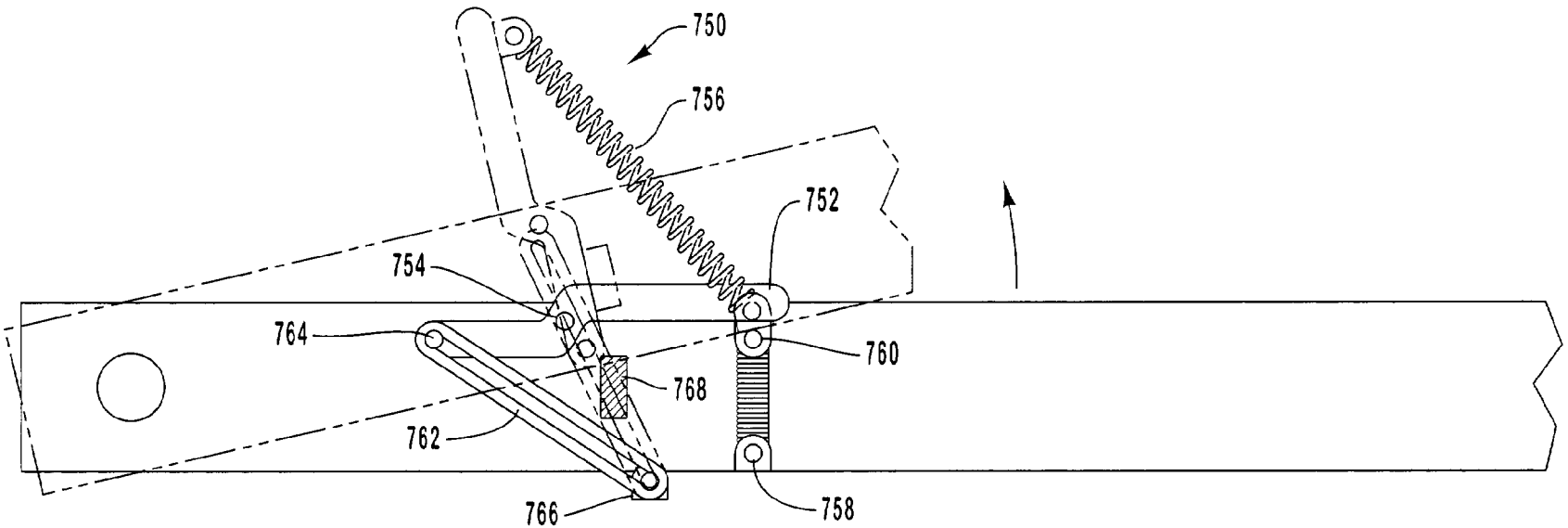
FIG. 10 illustrates a tire blocking apparatus adapted to prevent advancement of a vehicle in the direction of the fixed end of a movable member configured to have an incline plane according to one aspect of the present invention.

With reference now to FIG. 10, there is shown a tire blocking apparatus 750. Tire blocking apparatus 750 is configured to be utilized with a movable member having a movable end that can be raised higher than a fixed end of the movable member such that the movable member can form an incline plane. Second movable member 40 and third movable member 50, are examples of a movable member that can form an incline plane. Tire blocking apparatus 750 comprises a first arm 752, a pivot 754, a biasing mechanism 756, a fastener 758, a fastener 760, a second arm 762, a fastener 764, a fastener 766, and a stop 768.

First arm 752 is coupled to movable member utilizing pivot 754. Pivot 754 provides an axis about which first arm 752 rotates. Biasing mechanism 756 is coupled to movable member and the top of first arm 752 utilizing fasteners 758 and 760. Biasing mechanism 756 is configured to bias first arm 752 in the retracted position. Second arm 762 is slideably coupled to the bottom of first arm 752 and a position independent from movable member utilizing fasteners 764 and 766. A stop is positioned to prevent rotation of first arm 752 greater than a given amount in the direction of the fixed end of the movable member.

When movable member is in a horizontal orientation, the absence of an offsetting force, biasing mechanism 756 maintains arm 752 in the retracted position. Where the movable end of the movable member is elevated, the increased displacement between pivot 754 and fastener 766 causes second arm 762 to straighten and results in force being exerted on first arm 752. The force exerted on first arm 752 causes the top of first arm 752 to rotate in the direction of the fixed end of the movable member. Stop 768 interacts with first arm 752 to limit rotation such that first arm 752 prevents the tire of a vehicle from advancing in the direction of the fixed end of the movable member. When the movable member is returned to a horizontal orientation first arm 752 will return to its original orientation and the vehicle can advance in the direction of the fixed end of the movable member (as long as the tire of a vehicle is not resting against first arm 752 to prevent it from returning to its original orientation.)

Commercial Garaging System

Figure 11:
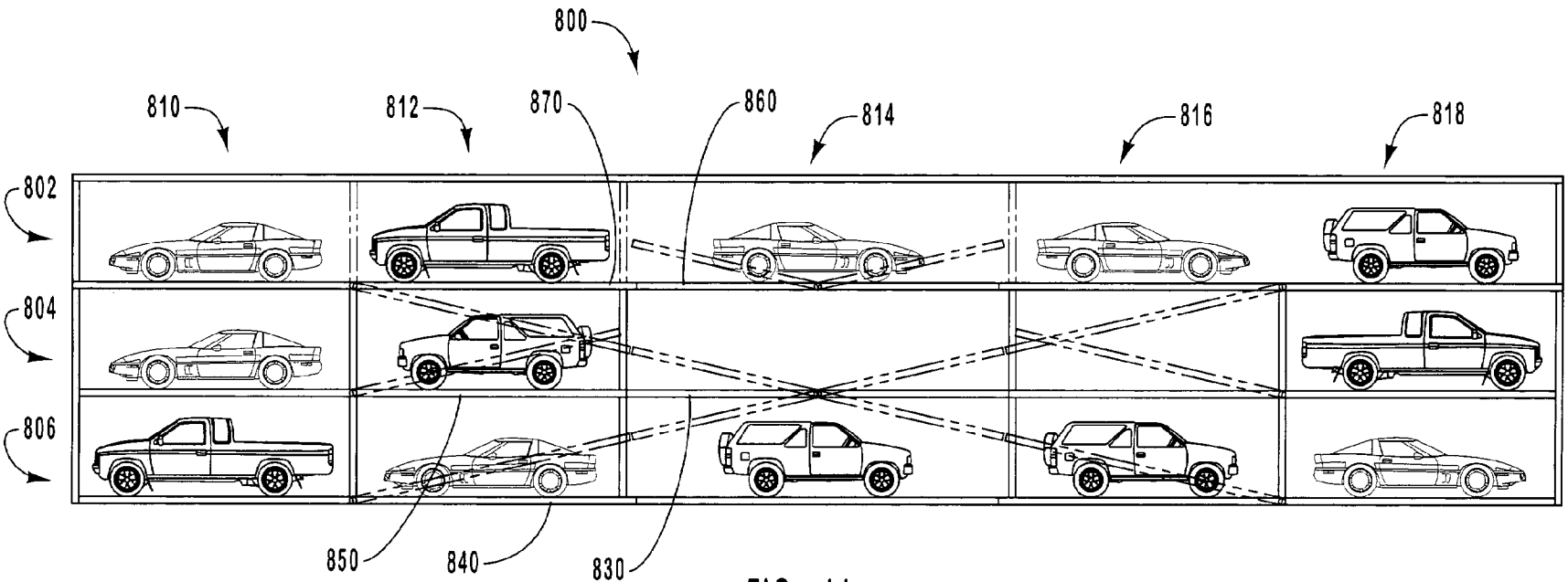
FIG. 11 is a side view of a commercial garaging system according to one aspect of the present invention.

With reference now to FIG. 11, there is shown a commercial garaging system 800. Commercial garaging system 800 operates utilizing the same principals as garaging system 1 disclosed with reference to FIGS. 1–10. Commercial garaging system 800 utilizes a movable member on one elevation and a movable member on a second elevation to form a transition ramp allowing a vehicle to be moved between different elevations. In the embodiment, a first elevation 802, a second elevation 804, and a third elevation 805 are shown. Each elevation includes a first parking spot 810, a second parking spot 812, a transition area 814, a third parking spot 816, and a fourth parking spot 818.

According to one aspect of the present invention, the commercial garaging system comprises a first movable member 830, a second movable member 840, a third movable member 850, a fourth movable member 860, and a fifth movable member 870 which are all located on one side of commercial garaging system 1. The commercial garaging system further comprises the mirror image of a first movable member 830, a second movable member 840, a third movable member 850, a fourth movable member 860, and a fifth movable member 870 on the other side of commercial garaging system. It can be seen that the stationary end of the first movable member 830 shares a common fixed point with the stationary end of the mirror version of first movable member 830. Both the first movable member 830 and the mirror version of the first movable member 830 correspond with spot 814 of first elevation 804. For the sake of clarity, movable members 830, 840, 850, 860, and 870 will be discussed in detail while the mirror version of movable members 830, 840, 850, 860, and 870 will not be discussed in great detail. It will be understood that both sides of commercial garaging system function in primarily the same manner.

In the illustrated embodiment, as with garaging system 1, movable members 830, 840, 850, 860, and 870 allow vehicles to be moved between different elevations. Movable members 830, 840, 850, 860, and 870 also function as a parking spot for vehicles on each elevation. Vehicles can be moved between third elevation 806 and second elevation 804 utilizing a ramp formed from first and second transition members 830 and 840. Vehicles can be moved between second elevation 804 and first elevation 802 utilizing a ramp formed from first and fourth transition members 830 and 860. Third and fifth transition members 850 and 870 are utilized to lift vehicles resting thereon to remove any obstruction to vehicles being moved utilizing the transition ramps.

Commercial garaging system 800 also includes a plurality of fixed surfaces corresponding with spots 810 and 818 of elevations 802, 804, 806. For example, a first fixed surface is adjacent the stationary first end of the second movable member 840, the first fixed surface being stationary on the third elevation 806. A second fixed surface is adjacent the stationary first end of the third movable member 850, the second fixed surface being stationary on the second elevation 806. A third fixed surface is adjacent the stationary first end of the fourth movable member 870, the third fixed surface being stationary on the first elevation 802.

The configuration of movable members 830, 840, 850, 860, and 870 allows cars parked in various locations in the garage to be accessed quickly and efficiently. Additionally, the use of garage space is maximized for parking of vehicles. For example, where spot 814 of second elevation 804 is utilized to access the parking structure, 14 vehicles can be parked utilizing ten ramps and two drive apparatuses as is shown in the illustrated embodiment. If one of the 14 spots is left available for repositioning vehicles, i.e. spot 816 of second elevation 802, each vehicle can be accessed by moving no more than a single vehicle.

As previously mentioned commercial garaging system 800 operates utilizing the same principals as garaging system 1 disclosed with reference to FIGS. 1–10. As will be appreciated by those skilled in the art, due to the changes in configuration, a variety of variations will be utilized from garaging system 1. For example, in one embodiment, a drive apparatus is utilized having a second displacement element coupled to a movable first end of a first movable member and a movable second end of a fourth movable member. In the embodiment, the driving mechanism has a second operational position adapted to provide lifting force to the second displacement element. In the embodiment, a second support member is also utilized. The second support member is adapted to interact with the second displacement element such that movement of the second displacement element simultaneously moves the first end of the first movable member towards the movable second end of the fourth movable member. While variations between commercial garaging system 800 and garaging system 1 will be employed, such variations will be obvious in light of the teachings of FIGS. 1–13.

According to one aspect of the present invention, the garaging structure utilized in connection with commercial garaging system 800 can be formed in whole, or in part, from frame members of commercial garaging system. This allows for increased efficiency and cost saving in constructing the garaging system. The configuration of commercial garaging system is not limited to that shown in FIG. 11. A variety of types and configurations of commercial garaging system can be utilized without departing from the scope and spirit of the present invention.

Figure 12:
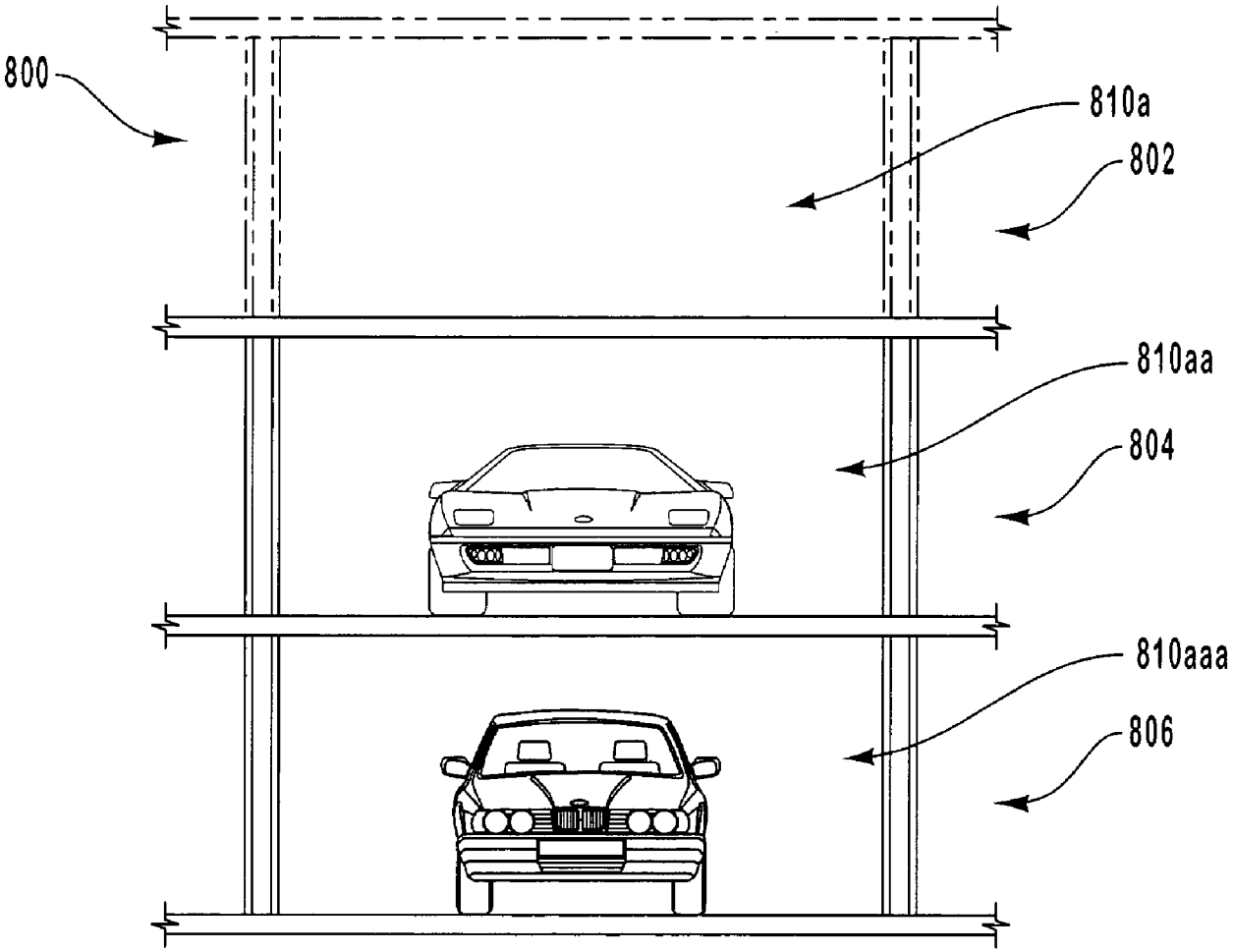
FIG. 12 is an end view illustrating a commercial garaging system according to one aspect of the present invention.

With reference now to FIG. 12, there is shown an end perspective view of a portion of commercial garaging system 800. There is shown a parking spot 810*a* corresponding with first elevation 802. There is shown a parking spot 810*aa* corresponding with second elevation 804. There is shown a parking sport 810*aaa* corresponding with third elevation 806. As will be appreciated by those skilled in the art, commercial garaging system 800 is not limited to three levels as illustrated in the present embodiment. For example, in one embodiment, commercial garaging system is comprised of two levels. In another embodiment, commercial garaging system is comprised of four or more levels.

Figure 13:
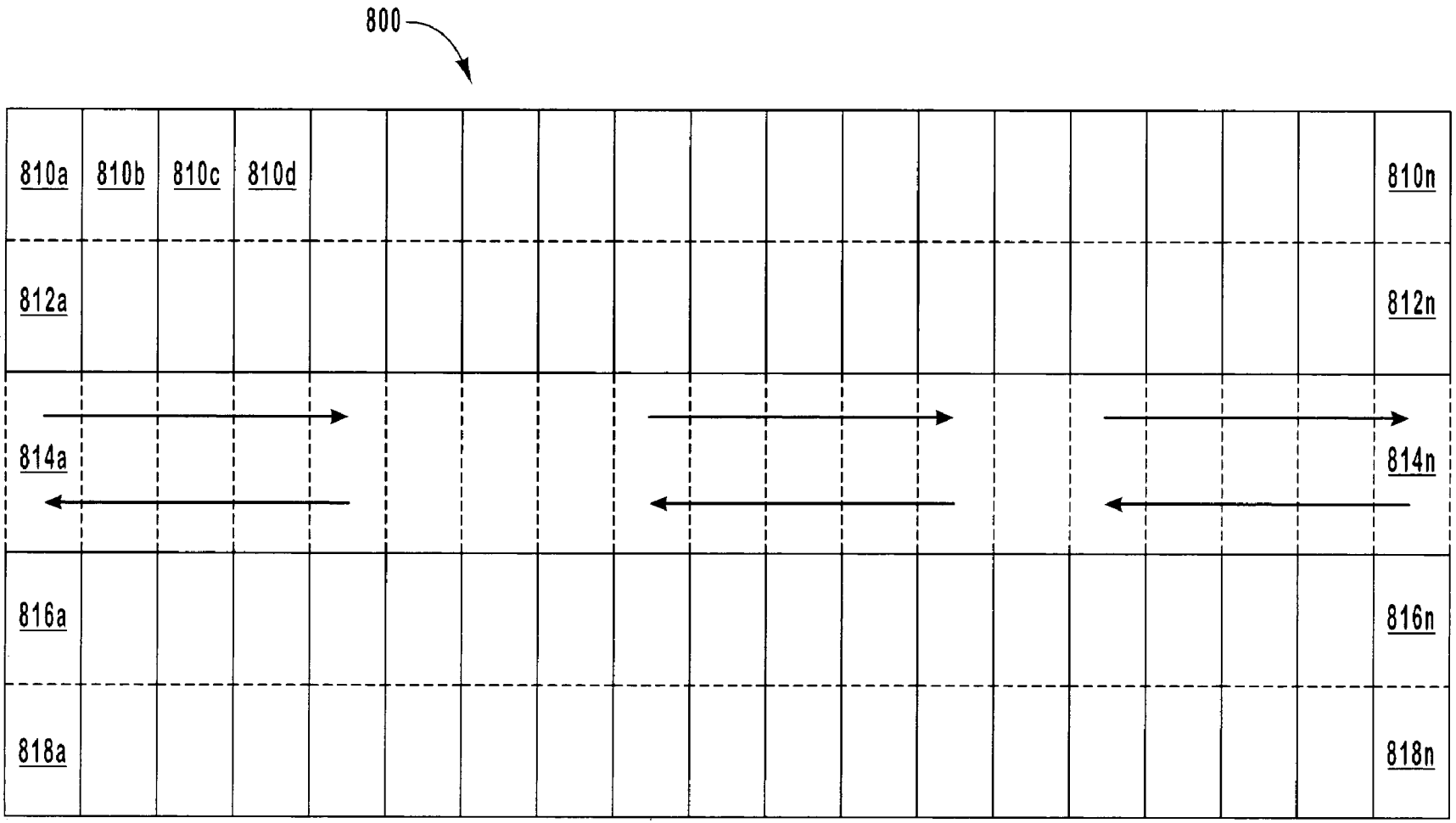
FIG. 13 is a top view illustrating a commercial garaging system according to one aspect of the present invention.

With reference now to FIG. 13, there is shown a top view of commercial garaging system 800 according to one aspect of the invention. In the embodiment, a plurality of parking spaces 810*a*–810*n* are positioned side by side. Similarly, a plurality of parking spaces 812*a*–*n*, 814*a*–*n*, 816*a*–*n*, and 818*a*–*n* are positioned side by side. Spaces 814*a*–*n* can be utilized as a transition area to laterally move cars between positions a–n. The number and configuration of parking spaces that can be utilized are not limited to those of the illustrated embodiment. For example, in one embodiment eight parking spots are positioned end to end with a first and second transition area. In the embodiment, two parking spots are located between the first and second transition area and on each side of the transition areas. In another embodiment, the number of parking spots that are position side by side is limited.

Although the invention hereof has been described by way of preferred embodiments, it will be evident that adaptations and modifications may be employed without departing from the spirit and scope thereof.

The terms and expressions employed herein have been used as terms of description and not of limitation; and, thus, there is no intent of excluding equivalents, but, on the contrary, it is intended to cover any and all equivalents that may be employed without departing from the spirit and scope of the invention.

What is claimed is:

1. A garaging system comprising:

a garage structure, comprising:

a housing structure including a roof and a front entrance;

a first area located between the roof and ground elevation; and a second area located within an excavated cavity below the first area; and a parking structure, comprising:

a first movable member positioned at the ground elevation near the front entrance of a garage, the first movable member allowing a vehicle to enter and exit the garage thereon;

a second movable member positioned at a second elevation at the base of the excavated cavity and positioned toward a rear boundary of the garage in comparison to the first movable member, the second elevation being below the ground elevation wherein the first movable member and the second movable member can be utilized to form a transition ramp permitting a vehicle to be moved between the ground elevation and the second elevation; and a third movable member positioned at the ground elevation adjacent the first movable member and near the rear boundary of the garage and adapted to permit a vehicle to be parked thereon.

2. The garaging system of claim 1, wherein the first movable member has a movable first end and a stationary second end, and the second movable member has a stationary first end and a movable second end.

3. The garaging system of claim 2, wherein the first movable member and the second movable member permit a vehicle to be moved from the ground elevation to the second elevation when the first end of the first movable member is positioned adjacent the second end of the second movable member.

4. The garaging system of claim 3, further comprising a drive apparatus adapted to simultaneously move the movable first end of the first movable member and the movable second end of the second movable member, wherein the drive apparatus permits the movable first end of the first movable member to be selectively positioned adjacent the movable second end of the second movable member.

5. The garaging system of claim 4, wherein the third movable is further adapted to permit a vehicle to be moved between the first and second elevation utilizing the first and second movable members without obstruction from the third movable member of the vehicle resting thereon.

6. The garaging system of claim 5, wherein the third movable member includes a stationery first end and a movable second end, wherein the movable second end of the third movable member is positioned on the ground elevation adjacent the movable first end of the first movable member and wherein the drive apparatus is adapted to simultaneously move the movable first end of the first movable member, the movable second end of the second movable member, and the movable second end of the third movable member.

7. The garaging system of claim 6, wherein the spacing between the movable second end of the second movable member and the movable second end of the third movable member remains uniform when moved by the drive apparatus.

8. The garaging system of claim 5, further including a frame assembly adapted to comprise part or all of a garage structure in which the garaging system is utilized.

9. The garaging system of claim 5, further comprising a tire blocking apparatus on at least one of the first, second and third movable members to maintain the position of one or more vehicles while the members are in a non-horizontal position.

10. The garaging system of claim 5, further comprising a carbon monoxide monitor capable of indicating and/or exhausting when dangerous levels of carbon monoxide build up in the garage.

11. The garaging system of claim 6, wherein, further comprising a stationary member positioned at the second elevation adjacent the second moveable member and vertically aligned below the first moveable member and adapted to permit a vehicle to be parked thereon.

12. The garaging system of claim 6, further comprising a spacer which has a first end attached to the movable second end of the third movable member and a second end attached to the movable second end of the second movable member, such that the second and third movable members move in parallel.

13. The garaging system of claim 4, wherein the third movable member is positioned at a sufficient elevation above the second movable member such that when the movable first end of the first movable member is positioned adjacent the movable second end of the second movable member, a vehicle can be moved from the ground elevation to the second elevation.

* * * * *